US007775940B2

(12) United States Patent
Dalebout et al.

(10) Patent No.: US 7,775,940 B2
(45) **Date of Patent: *Aug. 17, 2010**

(54) FOLDING ELLIPTICAL EXERCISE MACHINE

(75) Inventors: William T. Dalebout, North Logan, UT (US); Gaylen W. Ercanbrack, Logan, UT (US); Jaremy T. Butler, Paradise, UT (US); Robert L. Alleman, North Logan, UT (US)

(73) Assignee: Icon IP, Inc., Logan, UT (US)

( * ) Notice: Subject to any disclaimer, the term of this patent is extended or adjusted under 35 U.S.C. 154(b) by 445 days.

This patent is subject to a terminal disclaimer.

(21) Appl. No.: 11/549,530

(22) Filed: Oct. 13, 2006

(65) Prior Publication Data

US 2007/0129218 A1 Jun. 7, 2007
US 2008/0167163 A9 Jul. 10, 2008

Related U.S. Application Data

(63) Continuation-in-part of application No. 11/155,328, filed on Jun. 16, 2005.

(51) Int. Cl.
*A63B 22/00* (2006.01)
*A63B 22/06* (2006.01)

(52) U.S. Cl. ..... 482/52; 482/57

(58) Field of Classification Search ..... 482/51–54, 482/57, 62, 70, 79–80
See application file for complete search history.

(56) References Cited

U.S. PATENT DOCUMENTS 3,316,898 A 5/1967 Brown (Continued)

FOREIGN PATENT DOCUMENTS

CN 2169450 6/1994

(Continued)

OTHER PUBLICATIONS

Geartrends Fitness 2007 edition, available on information and belief at least as early as Jun. 1, 2007 (6 pages).

(Continued)

*Primary Examiner*—Steve R Crow
(74) *Attorney, Agent, or Firm*—Workman Nydegger

(57) ABSTRACT

A folding elliptical exercise machine is disclosed. The folding elliptical machine has a frame that comprises a base support structure and an upright support structure, wherein the base support structure has a front portion and a rear portion, the front portion having a first end and a second end, wherein the rear portion is rotatably attached to the front portion at a pivot mechanism such that the elliptical exercise machine is selectively moveable between an operating position and a storage position. The upright support structure extends upward from the first end of the front portion of the base support structure. The folding elliptical machine further comprises first and second reciprocating foot supports, each foot support having a first end and a second end, a drive assembly situated on the rear portion of the base support structure, and a ramp assembly situated at the first end of the front portion of the base support structure. The respective first ends of the first and second foot supports are releasably attached to the drive assembly and the ramp assembly has first and second guide rails for guiding the respective second ends of the first and second foot supports such that the foot supports move in an elliptical path.

32 Claims, 12 Drawing Sheets

U.S. PATENT DOCUMENTS

| | | | | |
|---|---|---|---|---|
| 3,501,140 | A | | 3/1970 | Eichorn |
| 3,756,595 | A | | 9/1973 | Hague |
| 3,824,994 | A | | 7/1974 | Soderberg, Sr. |
| 3,941,377 | A | | 3/1976 | Lie |
| 4,140,312 | A | | 2/1979 | Buchmann |
| 4,300,760 | A | | 11/1981 | Bobroff |
| 4,354,675 | A | | 10/1982 | Barclay |
| 4,679,787 | A | | 7/1987 | Guilbault |
| 4,708,338 | A | | 11/1987 | Potts |
| 4,720,093 | A | | 1/1988 | Del Mar |
| 4,938,474 | A | | 7/1990 | Sweeney et al. |
| 5,013,031 | A | | 5/1991 | Bull |
| 5,039,088 | A | | 8/1991 | Shifferaw |
| 5,078,389 | A | | 1/1992 | Chen |
| 5,135,447 | A | | 8/1992 | Robards, Jr. et al. |
| 5,195,935 | A | | 3/1993 | Fencel |
| D336,141 | S | | 6/1993 | Cole |
| 5,242,343 | A | * | 9/1993 | Miller ..... 482/57 |
| 5,279,529 | A | | 1/1994 | Eschenbach |
| 5,279,531 | A | | 1/1994 | Jen-Huey |
| D344,112 | S | | 2/1994 | Smith |
| 5,290,211 | A | | 3/1994 | Stearns |
| 5,299,993 | A | | 4/1994 | Habing |
| 5,322,491 | A | | 6/1994 | Wanzer et al. |
| 5,336,141 | A | | 8/1994 | Vittone |
| 5,352,169 | A | | 10/1994 | Eschenbach |
| 5,383,829 | A | | 1/1995 | Miller |
| D356,128 | S | | 3/1995 | Smith et al. |
| 5,415,607 | A | | 5/1995 | Carpenter |
| 5,419,751 | A | | 5/1995 | Byrd et al. |
| 5,423,729 | A | | 6/1995 | Eschenbach |
| 5,435,799 | A | | 7/1995 | Lundin |
| 5,435,801 | A | | 7/1995 | Hung |
| D367,689 | S | | 3/1996 | Wilkinson et al. |
| 5,499,956 | A | | 3/1996 | Habing et al. |
| 5,518,473 | A | | 5/1996 | Miller |
| 5,527,245 | A | | 6/1996 | Dalebout et al. |
| 5,527,246 | A | | 6/1996 | Rodgers |
| 5,529,554 | A | | 6/1996 | Eschenbach |
| 5,529,555 | A | | 6/1996 | Rodgers, Jr. |
| 5,540,637 | A | | 7/1996 | Rodgers, Jr. |
| 5,549,526 | A | | 8/1996 | Rodgers, Jr. |
| 5,562,574 | A | | 10/1996 | Miller |
| 5,573,480 | A | | 11/1996 | Rodgers, Jr. |
| 5,577,985 | A | | 11/1996 | Miller |
| 5,591,107 | A | | 1/1997 | Rodgers |
| 5,593,371 | A | | 1/1997 | Rodgers, Jr. |
| 5,593,372 | A | | 1/1997 | Rodgers, Jr. |
| 5,595,553 | A | | 1/1997 | Rodgers, Jr. |
| 5,595,556 | A | | 1/1997 | Dalebout et al. |
| 5,611,756 | A | | 3/1997 | Miller |
| 5,611,757 | A | | 3/1997 | Rodgers |
| 5,611,758 | A | | 3/1997 | Rodgers |
| 5,616,103 | A | | 4/1997 | Lee |
| 5,626,542 | A | | 5/1997 | Dalebout et al. |
| 5,637,058 | A | | 6/1997 | Rodgers |
| D380,509 | S | | 7/1997 | Wilkinson et al. |
| 5,653,662 | A | | 8/1997 | Rodgers, Jr. |
| D384,118 | S | | 9/1997 | Deblauw |
| 5,672,140 | A | | 9/1997 | Watterson et al. |
| 5,683,333 | A | | 11/1997 | Rodgers, Jr. |
| 5,685,804 | A | | 11/1997 | Whan-Tong et al. |
| 5,690,589 | A | | 11/1997 | Rodgers, Jr. |
| 5,692,994 | A | | 12/1997 | Eschenbach |
| 5,695,434 | A | | 12/1997 | Dalebout et al. |
| 5,695,435 | A | | 12/1997 | Dalebout et al. |
| 5,707,320 | A | | 1/1998 | Yu |
| 5,707,321 | A | | 1/1998 | Maresh |
| 5,722,922 | A | | 3/1998 | Watterson et al. |
| 5,738,614 | A | | 4/1998 | Rodgers, Jr. |
| 5,743,834 | A | | 4/1998 | Rodgers, Jr. |
| 5,755,642 | A | | 5/1998 | Miller |
| 5,766,113 | A | | 6/1998 | Rodgers, Jr. |
| 5,772,558 | A | | 6/1998 | Rodgers, Jr. |
| 5,779,599 | A | | 7/1998 | Chen |
| 5,782,722 | A | * | 7/1998 | Sands et al. ..... 482/52 |
| 5,788,609 | A | | 8/1998 | Miller |
| 5,788,610 | A | | 8/1998 | Eschenbach |
| 5,792,026 | A | | 8/1998 | Maresh et al. |
| 5,795,268 | A | | 8/1998 | Husted |
| 5,813,949 | A | | 9/1998 | Rodgers, Jr. |
| 5,823,917 | A | | 10/1998 | Chen |
| 5,830,113 | A | | 11/1998 | Coody et al. |
| 5,830,114 | A | | 11/1998 | Halfen et al. |
| 5,833,582 | A | | 11/1998 | Chen |
| 5,836,854 | A | | 11/1998 | Kuo |
| D403,033 | S | | 12/1998 | Husted et al. |
| 5,846,166 | A | | 12/1998 | Kuo |
| 5,857,941 | A | | 1/1999 | Maresh et al. |
| 5,860,893 | A | | 1/1999 | Watterson et al. |
| 5,860,895 | A | | 1/1999 | Lee |
| 5,873,608 | A | | 2/1999 | Tharp et al. |
| 5,897,460 | A | | 4/1999 | McBride et al. |
| 5,899,834 | A | | 5/1999 | Dalebout et al. |
| 5,904,637 | A | | 5/1999 | Kuo |
| 5,911,649 | A | | 6/1999 | Miller |
| 5,913,751 | A | | 6/1999 | Eschenbach |
| 5,916,064 | A | | 6/1999 | Eschenbach |
| 5,916,065 | A | | 6/1999 | McBride |
| 5,919,118 | A | | 7/1999 | Stearns et al. |
| 5,924,962 | A | | 7/1999 | Rodgers, Jr. |
| D413,366 | S | | 8/1999 | Husted et al. ..... D21/668 |
| 5,938,567 | A | | 8/1999 | Rodgers, Jr. |
| 5,938,570 | A | | 8/1999 | Maresh |
| 5,944,638 | A | | 8/1999 | Maresh et al. |
| 5,947,872 | A | | 9/1999 | Ryan et al. |
| 5,951,449 | A | | 9/1999 | Oppriecht |
| 5,957,814 | A | | 9/1999 | Eschenbach |
| 5,961,423 | A | | 10/1999 | Sellers |
| 5,997,445 | A | | 12/1999 | Maresh et al. |
| 6,001,046 | A | | 12/1999 | Chang |
| 6,004,244 | A | | 12/1999 | Simonson |
| 6,007,462 | A | | 12/1999 | Chen |
| 6,019,710 | A | | 2/2000 | Dalebout |
| 6,022,296 | A | | 2/2000 | Yu |
| 6,024,676 | A | | 2/2000 | Eschenbach |
| 6,027,431 | A | | 2/2000 | Stearns et al. |
| 6,030,319 | A | | 2/2000 | Wu |
| 6,030,320 | A | | 2/2000 | Stearns et al. |
| 6,042,512 | A | | 3/2000 | Eschenbach |
| 6,045,487 | A | | 4/2000 | Miller |
| 6,099,439 | A | | 8/2000 | Ryan et al. |
| 6,106,439 | A | | 8/2000 | Boland |
| 6,123,649 | A | | 9/2000 | Lee et al. |
| 6,123,650 | A | | 9/2000 | Birrell |
| 6,135,927 | A | | 10/2000 | Lo |
| 6,146,313 | A | | 11/2000 | Whan-Tong et al. |
| 6,149,551 | A | | 11/2000 | Pyles et al. |
| 6,165,107 | A | | 12/2000 | Birrell |
| 6,171,217 | B1 | | 1/2001 | Cutler |
| 6,176,814 | B1 | | 1/2001 | Ryan et al. |
| 6,190,289 | B1 | | 2/2001 | Pyles et al. |
| 6,196,948 | B1 | | 3/2001 | Stearns et al. |
| 6,206,804 | B1 | | 3/2001 | Maresh |
| 6,210,305 | B1 | | 4/2001 | Eschenbach |
| 6,217,486 | B1 | | 4/2001 | Rosenow |
| 6,248,044 | B1 | | 6/2001 | Stearns et al. |
| 6,261,209 | B1 | | 7/2001 | Coody |
| 6,277,055 | B1 | | 8/2001 | Birrell et al. |
| 6,315,702 | B1 | | 11/2001 | Ikonomopoulos |
| 6,338,698 | B1 | | 1/2002 | Stearns et al. |
| 6,361,476 | B1 | | 3/2002 | Eschenbach |
| 6,368,252 | B1 | | 4/2002 | Stearns |
| 6,390,953 | B1 | | 5/2002 | Maresh et al. |

| | | | | |
|---|---|---|---|---|
| 6,398,695 | B2 | 6/2002 | Miller | |
| 6,409,632 | B1 | 6/2002 | Eschenbach | |
| 6,422,976 | B1 | 7/2002 | Eschenbach | |
| 6,422,977 | B1 | 7/2002 | Eschenbach | |
| 6,436,007 | B1 | 8/2002 | Eschenbach | |
| 6,440,042 | B2 | 8/2002 | Eschenbach | |
| 6,482,132 | B2 | 11/2002 | Eschenbach | |
| 6,500,096 | B1 | 12/2002 | Farney | |
| 6,544,147 | B1 | 4/2003 | Wang et al. | |
| 6,551,217 | B2 | 4/2003 | Kaganovsky | |
| 6,582,343 | B2 | 6/2003 | Lin et al. | |
| 6,612,969 | B2 | 9/2003 | Eschenbach | |
| 6,645,125 | B1 | 11/2003 | Stearns et al. | |
| 6,685,607 | B1 | 2/2004 | Olson | |
| 6,730,002 | B2 | 5/2004 | Hald et al. | |
| 6,749,540 | B1 | 6/2004 | Pasero et al. | |
| 6,752,744 | B2 * | 6/2004 | Arnold et al. | 482/52 |
| 6,758,790 | B1 | 7/2004 | Ellis | |
| 6,783,481 | B2 | 8/2004 | Stearns et al. | |
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 * | 4/2005 | Watterson et al. | 482/57 |
| 6,949,053 | B1 | 9/2005 | Stearns et al. | |
| 6,949,054 | B1 | 9/2005 | Stearns et al. | |
| 6,979,283 | B2 * | 12/2005 | Pan et al. | 482/54 |
| 7,025,711 | B2 | 4/2006 | Eschenbach | |
| 7,033,305 | B1 | 4/2006 | Stearns et al. | |
| 7,052,440 | B2 | 5/2006 | Pyles et al. | 482/54 |
| 7,060,005 | B2 | 6/2006 | Carlsen et al. | |
| 7,097,592 | B2 | 8/2006 | Wang | |
| 7,169,087 | B2 | 1/2007 | Ercanbrack et al. | |
| 7,192,388 | B2 | 3/2007 | Dalebout et al. | |
| 7,201,707 | B1 | 4/2007 | Moon | |
| 7,214,167 | B2 | 5/2007 | Stearns et al. | |
| 7,278,955 | B2 | 10/2007 | Giannelli et al. | |
| D554,715 | S | 11/2007 | Giannelli et al. | |
| D563,489 | S | 3/2008 | Giannelli et al. | |
| D564,051 | S | 3/2008 | Giannelli et al. | |
| 7,513,855 | B1 | 4/2009 | Yeh | |
| 2002/0086779 | A1 | 7/2002 | Wilkinson | |
| 2002/0198084 | A1 | 12/2002 | Stearns et al. | |
| 2003/0045403 | A1 | 3/2003 | Watterson et al. | |
| 2003/0083177 | A1 | 5/2003 | Tung | |
| 2003/0092532 | A1 | 5/2003 | Giannelli et al. | |
| 2004/0077463 | A1 | 4/2004 | Rodgers, Jr. | |
| 2004/0132583 | A1 | 7/2004 | Ohrt et al. | |
| 2004/0157706 | A1 | 8/2004 | Miller | |
| 2004/0162191 | A1 | 8/2004 | Ercanbrack et al. | |
| 2004/0198561 | A1 | 10/2004 | Corbalis et al. | |
| 2004/0204294 | A2 | 10/2004 | Wilkinson et al. | 482/54 |
| 2004/0224825 | A1 | 11/2004 | Giannelli et al. | |
| 2005/0009668 | A1 | 1/2005 | Savettiere et al. | |
| 2005/0026752 | A1 | 2/2005 | Lull et al. | |
| 2005/0101463 | A1 | 5/2005 | Chen | |
| 2005/0130807 | A1 | 6/2005 | Cutler et al. | |
| 2005/0164837 | A1 | 7/2005 | Anderson et al. | |
| 2005/0181912 | A1 | 8/2005 | Eschenbach | |
| 2005/0202939 | A1 | 9/2005 | Lull et al. | |
| 2005/0209059 | A1 | 9/2005 | Crawford et al. | |
| 2006/0019804 | A1 | 1/2006 | Young | |
| 2006/0035754 | A1 | 2/2006 | Giannelli et al. | |
| 2006/0035755 | A1 | 2/2006 | Dalebout et al. | |
| 2006/0040794 | A1 | 2/2006 | Giannelli et al. | |
| 2006/0166791 | A1 | 7/2006 | Liao et al. | |
| 2006/0217236 | A1 | 9/2006 | Watterson et al. | |
| 2006/0234838 | A1 | 10/2006 | Dalebout et al. | |
| 2006/0247103 | A1 | 11/2006 | Stearns et al. | |
| 2006/0287161 | A1 | 12/2006 | Dalebout et al. | |
| 2007/0015633 | A1 | 1/2007 | Gerschefske et al. | 482/52 |
| 2007/0060449 | A1 | 3/2007 | Lo | |
| 2007/0060450 | A1 | 3/2007 | Lo | |
| 2007/0117683 | A1 | 5/2007 | Ercanbrack et al. | |
| 2007/0123393 | A1 | 5/2007 | Giannelli et al. | |
| 2007/0123394 | A1 | 5/2007 | Ercanbrack et al. | |
| 2007/0129217 | A1 | 6/2007 | Giannelli et al. | |
| 2007/0129218 | A1 | 6/2007 | Dalebout et al. | |
| 2007/0162823 | A1 | 7/2007 | Lin et al. | |
| 2007/0179023 | A1 | 8/2007 | Dyer | |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |
| 2008/0200314 | A1 | 8/2008 | Dalebout et al. | 482/52 |

FOREIGN PATENT DOCUMENTS

| | | |
|---|---|---|
| CN | 1315878 | 10/2001 |
| CN | 2516647 | 10/2002 |
| CN | 2696675 | 5/2005 |
| DE | 229712 | 1/1911 |
| FR | 498.150 | 6/1916 |
| WO | WO95/00209 | 1/1995 |
| WO | WO96/08292 | 3/1996 |
| WO | 99/58204 | 11/1999 |
| WO | WO 2006/138601 | 12/2006 |
| WO | WO 2008/103612 | 8/2008 |

OTHER PUBLICATIONS

Cybex Cross-Training, "CYBEXceptional," including pages relating to Nova 7 award, Cybex Arc Trainer Nova 7 2004 & 2005 "Best Product of the Year," and "Total Body Arc Trainer the Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17i Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commercial.lifefitness.com, "Summit Trainers," printed Oct. 17, 2006 (3 pages).

Internet archive for www.us.commercial.lifefitness.com, at http://web.archive.org/web/20061016230321/us.commerical.lifefitness.com/, "Summit Trainers," available on information and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages, available on information and belief at least as early as Jul. 17, 2007 (includes brochure pp. 38-41, 66).
Brochure: "Reach Your Summit," 7 pages, available on information and belief at least as early as Nov. 1, 2006.
Operations Manual, 95Le Summit Trainer, LifeFitness, 53 pages, copyright 2006.
Operations Manual, 95Li Summit Trainer, LifeFitness, 39 pages, copyright 2006.
Assembly Instructions, 95Li Summit Trainer, LifeFitness, 10 pages, available on information and belief at least as early as Dec. 18, 2006.
LifeFitness, "Biomechanical Research Presents Benefits of New Summit Trainer," copyright 2006 (2 pages).
Photographs of Octane Fitness Exercise Device, available on information and belief at least as early as Sep. 2006, 8 photographs (3 pages).
Horizon Series E30 E20, printed on Jul. 27, 2004 from www .horizonfitness.com/horizon-series/ellipticals/e20.php, (1 page).
Horizon Elliptical Specs, printed on Jul. 27, 2004 from www.horizonfitness.com/horizon-series/ellipticals/elliptical-spec.php, (1 page).
User's Manual, NordicTrack CX 998, Model No. 70950, 28 pages, available on information and belief at least as early as Jan. 29, 2005.
User's Manual, NordicTrack EX 1000 Commercial Pro, Model No. NTEL 4255.1, 28 pages, available on information and belief at least as early as May 24, 2006.
User's Manual, Pro-Form XP 520 Razor Elliptical Exerciser, Model No. 831.23744.0, 28 pages, available on information and belief at least as early as Jun. 19, 2007.
Office Action dated Dec. 14, 2007 from U.S. Appl. No. 10/916,684 (10 pages).
Office Action dated Jul. 18, 2008 from U.S. Appl. No. 11/155,328 (9 pages).
Office Action dated May 14, 2008 from U.S. Appl. No. 11/676,643 (14 pages).
Operations Manual, Q47/Q47e/Q47ce Exercise Device, Octane Fitness, 52 pages, copyright 2007.
Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2005 (1 page).
Internet archive for www.octanefitness.com, "Press Room," available on information and belief at least as early as Dec. 20, 2005 (1 page).
Internet archive for www.octanefitness.com, "Research," available on information and belief at least as early as Sep. 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainers," Impact your life, not your body! "Total Body Workout," "Minimal Maintenance," "Small Footprint," "Retailers," available on information and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," "Programs Q45/Q45e," "Programs Pro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," "SmartStride Q45/Q45e," "SmartStride Q45/Q45e," "Elliptical Shopping Guide," "Specs," (2 pages), Consumer Guide Best Buy, "Octane Q45e," Consumer Guide Best Buy, "Octane Q35e," "Heart Rate Training," (3 pages), available on information and belief at least as early as Mar. 14, 2006 (20 total pages).
Office Action dated Oct. 17, 2007 from U.S. Appl. No. 10/916,684 (7 pages).
Office Action dated Sep. 3, 2008 from U.S. Appl. No. 10/916,684 (11 pages).
Office Action dated Jan. 29, 2009 from U.S. Appl. No. 11/916,684 (10 pages).
Office Action dated Jun. 9, 2009 from U.S. Appl. No. 11/916,684 (11 pages).
Office Action dated Jan. 7, 2009 from U.S. Appl. No. 11/155,328 (10 pages).
Notice of Allowance dated May 18, 2009 from U.S. Appl. No. 11/155,328 (5 pages).
Office Action dated Dec. 20, 2007 from U.S. Appl. No. 11/676,643 (7 pages).
Office Action dated Jan. 23, 2009 from U.S. Appl. No. 11/676,643 (16 pages).
Office Action dated Apr. 3, 2009 from People's Republic of China Patent Application No. 200680021835.9 and English translation thereof (21 pages).
Comments and Suggestions relating to Apr. 3, 2009 Office Action in People's Republic of China Patent Application No. 200680021835.9, Apr. 2009 (3 pages).
Office Action dated Sep. 22, 2009 from U.S. Appl. No. 11/155,328 (10 pages).
Amendment "B" and Response to Final Office Action from U.S. Appl. No. 11/155,328, submitted Apr. 7, 2009, 19 pages.
Amendment "B" and Response to Final Office Action from U.S. Appl. No. 11/676,643, submitted May 11, 2009, 22 pages.
Amendment "F" With RCE After Final Office Action from U.S. Appl. No. 10/916,684, submitted Sep. 9, 2009, 17 pages.
Notice of Allowance and Fees Due dated Oct. 30, 2009 for U.S. Appl. No. 11/676,643 (8 pages).
Office Action dated Oct. 29, 2009 for U.S. Appl. No. 10/916,684 (9 pages).
Pro-Form 850 User's Manual (Model No. PFEL5105.0), available, on information and belief, at least as early as 2005, 24 pages.
Notice of Allowance dated Jul. 10, 2009 from U.S. Appl. No. 11/676,643, 9 pages.
Written Opinion of the International Searching Authority for International Application No. PCT/US08/54120, mailed Nov. 19, 2008, 7 pages.
Written Opinion of the International Searching Authority for International Application No. PCT/US08/23544, mailed Jan. 4, 2007, 4 pages.
Office Action dated Sep. 3, 2008 from U.S. Appl. No. 10/916,684 (10 pages).
Office Action dated Jan. 29, 2009 from U.S. Appl. No. 10/916,684 (10 pages).
Office Action dated Jan. 23, 2009 from U.S. Appl. No. 11/676,653 (16 pages).
Office Action dated Jan. 7, 2009 from U.S. Appl. No. 11/155,328 (10 pages).
Vision Fitness—About Our Ellipticals; www.visionfitness.com; taken from cite Sep. 13, 2005.

* cited by examiner

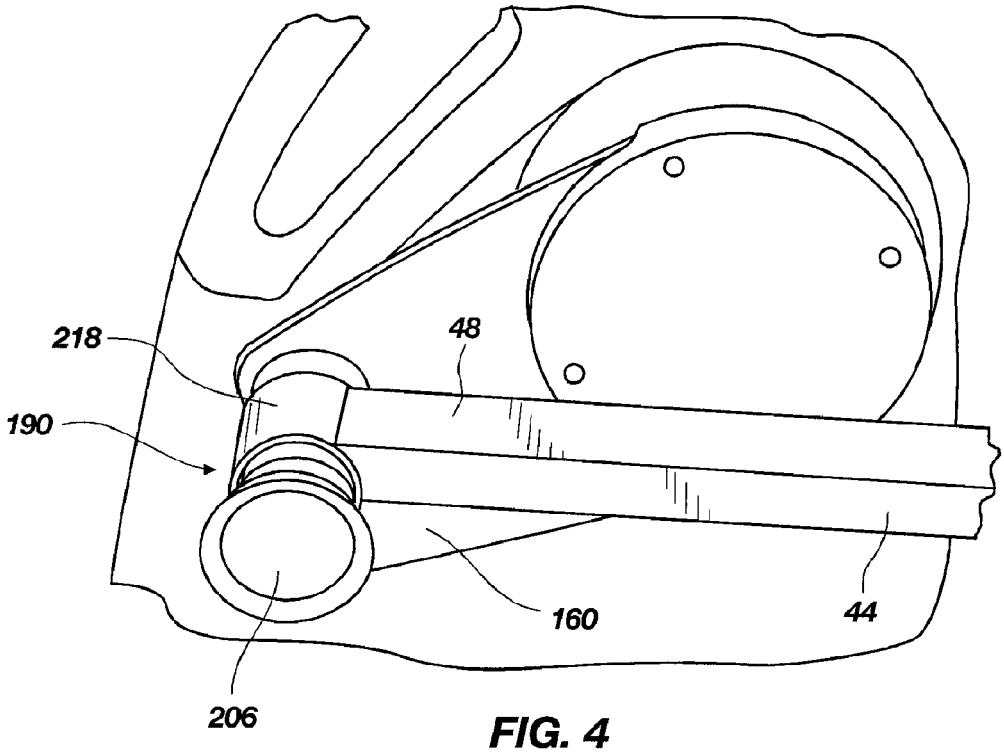
FIG. 4
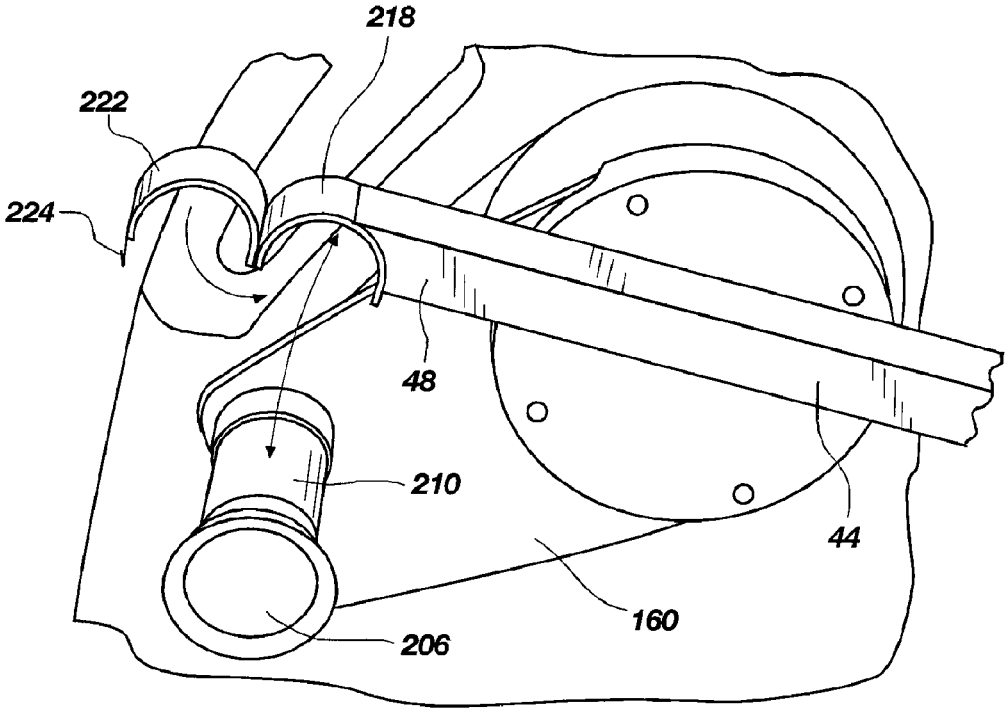
Fig. 5-A

Fig. 5-B

FOLDING ELLIPTICAL EXERCISE MACHINE

RELATED APPLICATIONS

This is a continuation-in-part of U.S. application Ser. No. 11/155,328, entitled "Breakaway or Folding Exercise Machine," filed Jun. 16, 2005, which is hereby incorporated herein in its entirety by reference.

BACKGROUND OF THE INVENTION

1. The Field of the Invention

This invention generally relates to exercise equipment and, more specifically, to a folding elliptical exercise machine.

2. The Relevant Technology

Exercise machines having alternating reciprocating foot supports configured to traverse or travel about a closed path to simulate a striding, running, walking, and/or a climbing motion for the individual using the machine are well known in the art, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point, with the other end supported in a manner configured to cause the reciprocating foot support to travel or traverse a closed path, such as a reciprocating elliptical or oblong path or other similar geometric outline. Therefore, upon operation of the exercise machine, each reciprocating foot support is caused to travel or traverse the closed path, thereby simulating a striding motion of the user for exercise purposes. The reciprocating foot supports are configured to be out of phase with one another by 180° in order to simulate a proper and natural alternating stride motion.

An individual may utilize an elliptical exercise machine by placing his or her feet onto the reciprocating foot supports. The individual may then actuate the exercise machine for any desired length of time to cause the reciprocating foot supports to repeatedly travel their respective closed paths, which action effectively results in a series of strides achieved by the individual to obtain exercise, with a low-impact advantage. An elliptical exercise machine may further comprise mechanisms or systems for increasing the resistance of the motion. In addition, the reciprocating motion of the feet to achieve a series of strides may be complemented by a reciprocating movement of the arms, whether assisted by the exercise machine via a suitably configured mechanism or system, or unassisted.

Being subject to function over form, elliptical exercise machines, by design, are large in size and tend to occupy a large amount of vertical and horizontal space during operation. In some instances, elliptical exercise machines may occupy a substantial amount of horizontal space, commonly referred to as a footprint, measuring several feet in width and often at least three times this in length. This being said, exercise machines, while very useful, do not provide a particularly attractive presence. Indeed, they can require a significant amount of space for operation. While space is not a major issue in most commercial settings, such as athletic fitness or sports centers, spas, resorts, etc., the same is not true when the exercise machine is intended for residential use. Therefore, exercise machines are designed to occupy as little space as possible. Still further, and particularly with respect to those intended for residential use, exercise machines are designed to comprise some type of folding mechanism that allows the exercise machine to fold upon itself in one or more ways in order to reduce the occupied space when the exercise machine is not in use. Such folding capabilities are also advantageous when packaging and/or transporting exercise machines.

Although many design endeavors to reduce the footprint of exercise machines, such as treadmills, have successfully been implemented, these same endeavors have not been favorably amenable to elliptical or elliptical-type exercise machines. This may largely be due to the bulky and weighty drive assembly and associated components common on most elliptical exercise machines. Because of the size and weight of the drive assembly, most attempts to provide elliptical exercise machines with some type of folding mechanism have resulted in only the folding of the handles and the vertical support member extending upward from the support frame to the user interface in a downward manner toward the drive assembly. One problem with this type of folding arrangement is that, although the vertical space being occupied by the elliptical exercise machine is reduced, the horizontal space being occupied, or the footprint, remains unchanged.

As such, there is a need for an elliptical exercise machine that provides all of the beneficial operational functions of prior related elliptical exercise machines while in operation, but that also is capable of substantially reducing the space being occupied by the elliptical exercise machine, namely the horizontal space or the footprint.

BRIEF SUMMARY OF THE INVENTION

In light of the problems and deficiencies inherent in the prior art, the present invention seeks to overcome these by providing an exercise machine having a centrally located pivot joint in the base support structure of an elliptical exercise machine that enables it to fold into a compact configuration.

Thus, a folding elliptical exercise machine is disclosed. The folding elliptical machine has a frame that comprises a base support structure and an upright support structure, wherein the base support structure has a front portion and a rear portion, the front portion having a first end and a second end, wherein the rear portion is rotatably attached to the front portion at a pivot mechanism such that the elliptical exercise machine is selectively moveable between an operating position and a storage position. The upright support structure extends upward from the first end of the front portion of the base support structure. The folding elliptical machine further comprises first and second reciprocating foot supports, each foot support having a first end and a second end, a drive assembly situated on the rear portion of the base support structure, and a ramp assembly situated at the first end of the front portion of the base support structure. The respective first ends of the first and second foot supports are releasably attached to the drive assembly and the ramp assembly has first and second guide rails for guiding the respective second ends of the first and second foot supports such that the foot supports move in an elliptical path.

The elliptical exercise machine further comprises first and second swing arms, wherein each arm has an upper portion and a lower portion, the upper portion of each arm being pivotally connected to the upright support structure, the lower portion of each arm being interconnected to the respective first and second foot supports. In addition, the elliptical exercise machine further comprises first and second link arms, wherein each link arm has a first end and a second end, wherein the lower portion of each swing arm is pivotally connected to the first end of each respective link arm and the second end of each respective link arm is connected to the respective first and second foot supports.

In one embodiment, the folding elliptical exercise machine of the present invention further comprises a locking mechanism that, in the storage position, prevents the rear portion of the base support structure from inadvertently rotating with respect to the front portion of the base support structure. In addition, the exercise machine may further comprise a button for disengaging the locking mechanism such that the rear portion can rotate with respect to the front portion of the base support structure to place the exercise machine in the operating position.

Further, the exercise machine may further comprise a mechanism wherein a first end of the ramp assembly is affixed to the front portion of the base support structure and a second end is adjustably mounted on the upright support structure such that an angle that the ramp assembly makes with the base support structure can be changed. In this way, the elliptical path that each foot support makes, and thereby foot of a user takes on the machine, can be varied.

BRIEF DESCRIPTION OF THE DRAWINGS

In order that the manner in which the above-recited and other advantages and objects of the invention are obtained, a more particular description of the invention briefly described above will be rendered by reference to specific embodiments thereof that are illustrated in the appended drawings. These drawings depict only typical embodiments of the invention. They are not therefore to be considered to be limiting of its scope, the invention will be described and explained with additional specificity and detail through the use of the accompanying drawings in which:

FIG. 4 illustrates an enlarged, cut-away view of one reciprocating foot support of the elliptical exercise machine of FIG. 1 as it attaches to a strut of a corresponding drive component;

FIG. 5-B illustrates an enlarged, cut-away perspective rear view of another embodiment of a locking mechanism of a reciprocating foot support of FIG. 4;

DETAILED DESCRIPTION OF THE PREFERRED EMBODIMENTS

Figure 1:
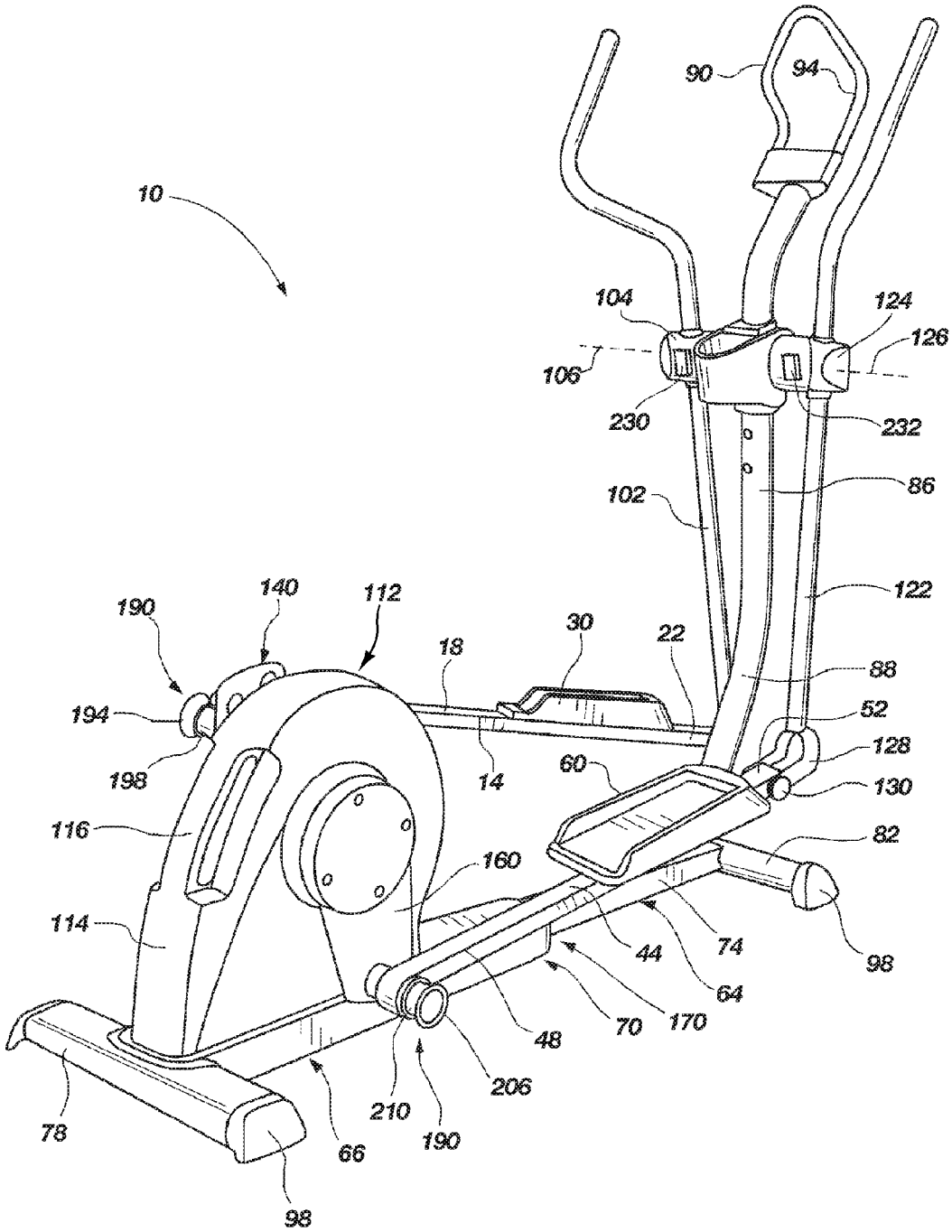
FIG. 1 illustrates a perspective view of a rear mechanism elliptical exercise machine according to the present invention.

The following detailed description of exemplary embodiments of the invention makes reference to the accompanying drawings, which show, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in the figures, is not intended to limit the scope of the invention, as claimed, it is presented for purposes of illustration only and to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes and features an exercise machine, and particularly an elliptical or elliptical-type exercise machine having one or more breakaway components that facilitate the folding of the elliptical exercise machine into a compact configuration, and more particularly an upright compact configuration. In one exemplary embodiment, the elliptical exercise machine may comprise a pivoting joint, or breakaway joint, located in its support frame. The breakaway joint may be complemented by, and the elliptical exercise machine may further comprise, breakaway reciprocating foot supports that further facilitate the folding of the elliptical exercise machine into a compact configuration.

At the outset, although many of the principles, exercise machines, systems, devices, assemblies, mechanisms, and methods described herein are discussed primarily in terms of their use with those types of elliptical exercise machines having a rear mount drive component or crank that utilizes swing arms, one ordinarily skilled in the art will understand that such principles, exercise machines, systems, devices, assemblies, mechanisms, and methods are adaptable, without undue experimentation, to be useable on an elliptical exercise machine or other similar type of exercise machine having a front mount configuration, wherein the closed path is generated by a front mount drive component, such as on a front mechanical-type exercise machine, or through any other manner, and are similarly adaptable for use on those types of exercise machines having stationary or fixed hand grips or handlebars.

The present invention provides several significant advantages over many prior related elliptical exercise machines, some advantages of which are recited here and throughout the following more detailed description. First, by providing releasable or detachable reciprocating foot supports, the elliptical exercise machine may comprise a pivot joint located approximately centrally, or thereabout, and away from either of its ends. Second, by providing an approximately centrally located pivot joint that is away from either end, the elliptical exercise machine is capable of folding into a more compact configuration than prior related machines. Third, the present invention allows the elliptical exercise machine to be stored in an upright position, rather than a prone position. This may allow the elliptical exercise machine to fit into tighter storage spaces than would otherwise be possible. With reference to the accompanying drawings, each of these advantages will be apparent in light of the detailed description set forth below. These advantages are not meant to be limiting in any way. Indeed, other than those specifically recited herein, one skilled in the art will appreciate that other advantages may be realized, upon practicing the present invention.

Figure 2:
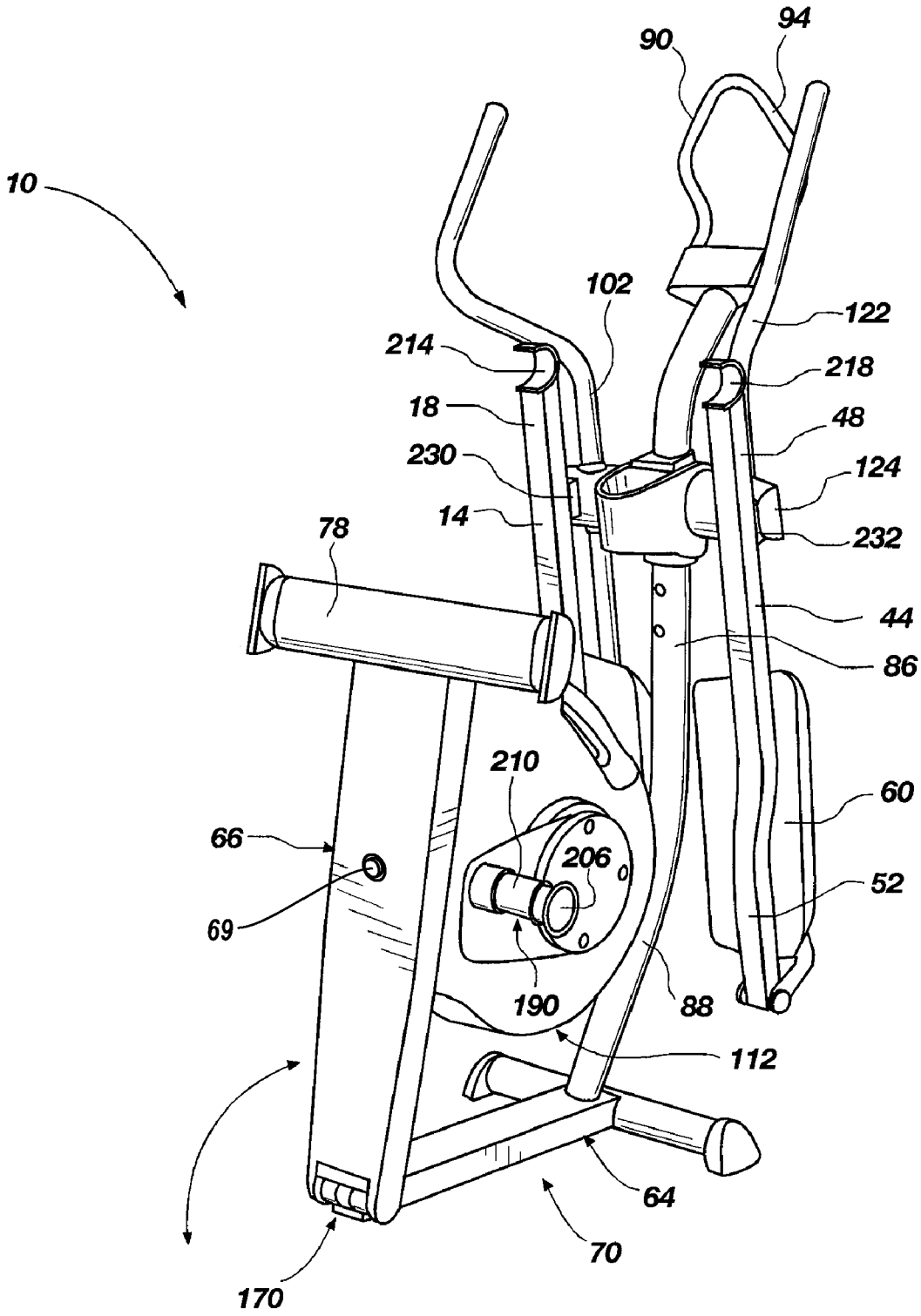
FIG. 2 illustrates a perspective view of the elliptical exercise machine of FIG. 1 in a folded configuration.

FIGS. 1 and 2 show various perspective views of a rear mount or rear mechanical-type elliptical exercise machine according to one exemplary embodiment of the present invention. Specifically, FIGS. 1 and 2 illustrate the elliptical exercise machine 10 comprising a first reciprocating foot support 14 having a first end 18, a second end 22, and a corresponding foot pad 30 provided thereon between the first end 18 and the second end 22 and that is sized and configured to receive a foot of a user. Complementing the first reciprocating foot support 14 is a second reciprocating foot support 44 having a first end 48, a second end 52, and a corresponding foot pad 60 provided thereon between the first end 48 and the second end 52 that also is sized and configured to receive a foot of a user. The first and second reciprocating foot supports 14 and 44 are laterally spaced apart from one another, such that each of the corresponding foot pads 30 and 60, respectively, comfortably receive a respective foot of a user for facilitating performance of a striding motion with the user facing in the forward direction. It is noted herein, that the foot pads 30 and 60 may be coupled, mounted, or otherwise operatively located about the reciprocating foot supports 14 and 44, respectively. It is also noted that the reciprocating foot supports 14 and 44 may be alternatively configured without foot pads, with the user standing directly on the upper surface of the reciprocating foot supports 14 and 44. In such an embodiment, a non-slip material may be added to the surface of the reciprocating foot supports to help maintain a sure footing.

The reciprocating foot supports 14 and 44, as well as the other components of the exercise machine, such as the drive assembly, are supported on a resting surface by a base support structure 70. The base support structure 70 is configured to provide both structural and translational support to the components of the exercise machine 10, and also to interface with the ground or other suitable support surface. The base support structure 70 generally defines the size of the foot print of the exercise machine 10.

Advantageously, the base support structure 70 of the present invention is configured to pivot or breakaway, thus allowing the elliptical exercise machine 10 to be folded into a compact configuration and then back again as desired. Specifically, the base support structure 70 is configured with some type of pivoting means that pivotally couples together at least two components of the base support structure 70 and that allows at least a portion of the base support structure to fold about at least another portion of the base support structure 70 for the purpose of compacting the elliptical exercise machine (e.g., for storage purposes) (see FIG. 2). Stated differently, the base support structure 70 comprises a first or front portion 64 (or front base support) and a second or rear portion 66 (or rear base support) operably and pivotally coupled to one another via a pivot mechanism or assembly, wherein the first or front portion 64 and the second or rear portion 66 are configured to breakaway from and fold at least partially upon one another to achieve a compact structural configuration, as described in greater detail below. The location of the pivot or pivot joint is preferably positioned away or offset a distance from either end of the base support structure, and also, if applicable, from the upright support 86. With the pivot joint being located in such a location, the base support structure 70 provides a portion of the base support structure 70 to remain in contact with the support surface as its counterpart is rotated upward and the elliptical exercise machine is folded into a compact configuration. The portion of the base support structure 70 remaining in contact with the ground, in this case the front portion 64 of the longitudinal support beam 74 and the cross beam 82, is configured to provide the necessary support and stabilization to the elliptical exercise machine in its folded configuration. The base support structure 70 and the upright support structure 86 together comprise the frame of the exercise machine 10.

In the exemplary embodiment shown in FIGS. 1 and 2, the base support structure 70 comprises an I-beam configuration, wherein the I-beam comprises a longitudinal support beam 74 functioning as the primary support member, and first and second lateral cross beams 78 and 82 located about and extending in opposing directions from each end of the longitudinal support beam 74. Rubber or plastic caps 98 may be situated on each of the ends of the cross beams 78 and 82. In accordance with the present invention, the base support structure 70 comprises at least two components, namely a first or front portion 64 and a second or rear portion 66, that pivot with respect to one another. In the embodiment shown, the longitudinal support beam 74 is comprised of two separate pieces pivotally coupled together. The front piece of the longitudinal support beam 74 along with the second cross beam 82 make up the front portion 64 of the support base structure 70. Similarly, the rear piece of the longitudinal support beam 74 along with the first cross beam 78 make up the rear portion 66 of the support base structure 70. Each of the front and rear portions 64 and 66 are configured to be adjacent the ground or floor surface when the elliptical exercise machine 10 is being operated by a user.

As indicated, the elliptical exercise machine 10 comprises a pivoting mechanism or assembly configured to facilitate the pivoting of the front and rear portions with respect to one another. In one exemplary embodiment, as shown, the elliptical exercise machine 10 comprises a pivoting mechanism 170 located along the longitudinal length and between the longitudinal ends of the longitudinal support beam 74. In the embodiment shown, the pivoting mechanism 170 is located a distance from a midpoint of the longitudinal support beam 74, thus accommodating the drive assembly 112, including the housing or enclosure 114 enclosing all or a portion of the components of the drive assembly. The pivoting mechanism 170 is configured to permit the rear portion 66 to breakaway and pivot in an upward direction off of the ground and with respect to the front portion 64, which remains in contact with the ground, thus facilitating and enabling the breakaway of the base support structure 70 and the repositioning of the drive assembly 112, as shown in FIG. 2.

As shown, the exemplary elliptical exercise machine 10 is a rear mechanical-type machine with the rear portion 66 of the base support structure 70 being configured to support the drive assembly 112. With the drive assembly 112 supported about the rear portion 66, upward rotation of the rear portion 66 about the front portion 64 functions to cause the drive assembly 112, and its several components, to also be pivoted upward and inward toward the upright support 86, thus compacting the elliptical exercise machine 10.

In light of the upward and inward rotation of the rear portion 66, and resultantly the drive assembly 112, the base support structure 70, as well as its various component parts, particularly the front and rear portions 64 and 66, as well as the pivot mechanism 170, are configured to comprise the necessary size and strength to support the drive assembly 112 in a vertical or substantially vertical position, as well as in any number of intermediate positions. Such will be obvious to one skilled in the art.

Moreover, the base support structure 70 may be any suitable design, such as any suitable frame-like structure or other configuration. In addition, the base support structure 70 may comprise a plurality of different components configured to operatively couple together to form the base support structure 70. Essentially, the base support structure 70 may comprise any suitable design configured to perform and operate as intended, and therefore, the I-beam configuration discussed herein and shown in the drawings is not meant to be limiting in any way.

To assist the user in actuating the breakaway function of the elliptical exercise machine and pivoting or rotating the rear portion 66 upward, the present invention may feature one or more handles formed with the frame or other support members of the elliptical exercise machine. As shown in FIGS. 1 and 2, the elliptical exercise machine 10 comprises a handle 116 positioned rearward of the drive assembly 112. The handle 116 may be coupled to or be a part of the various frame components (not shown) used to provide the necessary support to the elliptical exercise machine 10. The handle 116 may comprise any configuration. The handle 116 functions to assist the user in lifting the rear portion 66 off of the ground for purposes of folding the elliptical exercise machine 10, as indicated herein. The handle 116 further functions to assist the user in unfolding and lowering the rear portion 66 back to the ground. The enclosure 114 may further comprise an opening to accommodate the handle, or may be a part of the handle itself. The location of the handle on the elliptical exercise machine is not critical except that it is to be positioned on the portion of the elliptical exercise machine intended to rotate and fold, which in the case of the exemplary embodiment of FIGS. 1-3 is the rear portion 66.

FIG. 2 further illustrates a locking feature of the present invention, wherein the rear portion 66 of the base support structure 70 may be locked into place once it is pivoted upward and into one or more folded positions. The locking mechanism for the base support structure 70 may be contained or supported within the base support structure 70, or one of its components, and may be configured to lock the base support portion in any one of a plurality of intermediate positions, as well as a fully rotated position with the elliptical exercise machine in its most compact configuration. In addition, a release mechanism may be configured to be operable with the locking mechanism to provide selective and actuated release of the locking mechanism. As shown in FIG. 2, the rear portion, and particularly the rear piece of the longitudinal support beam 74, comprises a button 69 configured to trigger the release of the locking mechanism when depressed. Of course, other types of release mechanisms may be employed. The button functions to actuate one or more components of the locking mechanism to free the rear portion, wherein it may then be pivoted downward.

Figure 3:
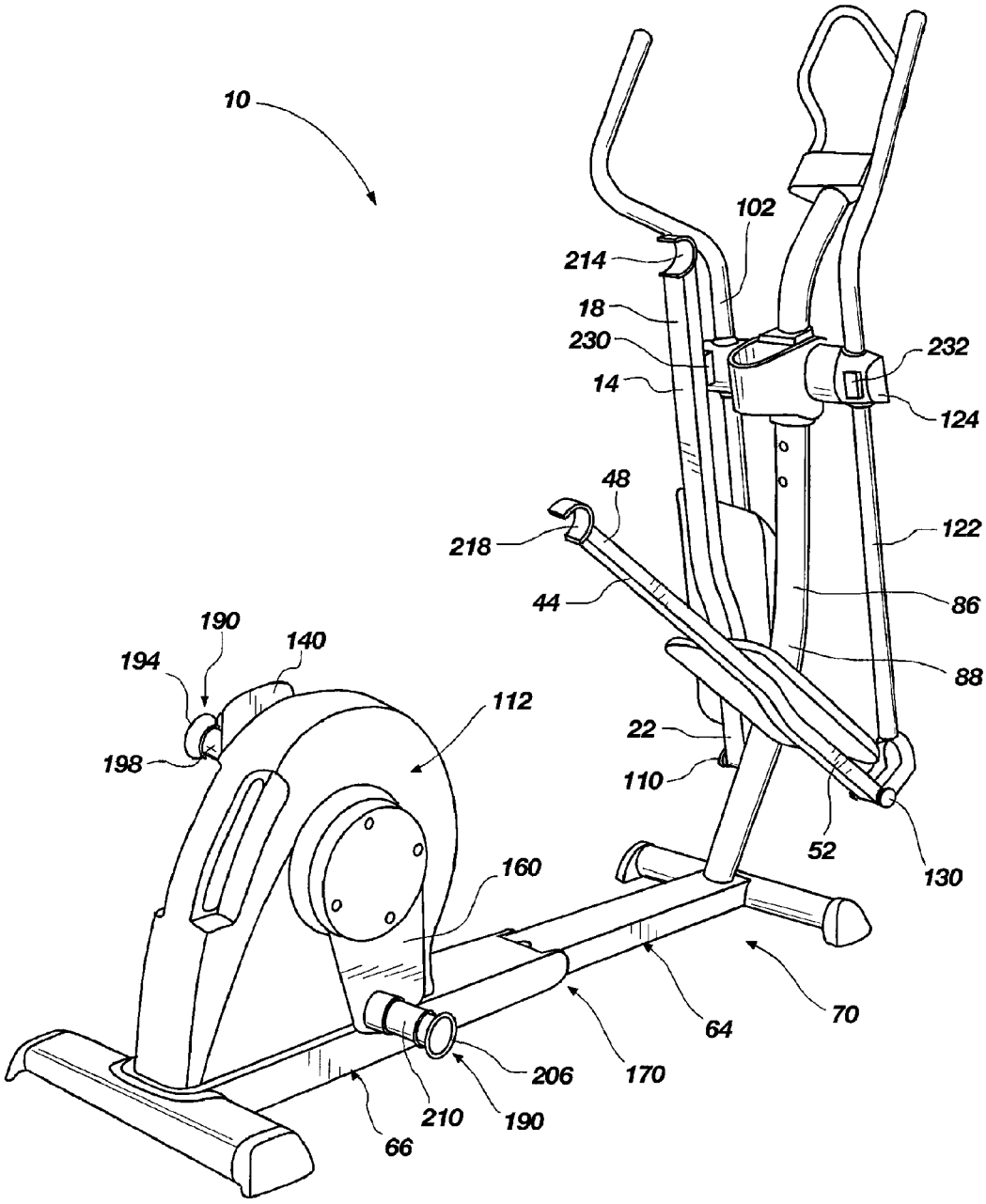
FIG. 3 illustrates a perspective view of the elliptical exercise machine of FIG. 1 with the reciprocating foot supports detached from their corresponding drive components.

FIGS. 1-3 illustrate additional features of the exemplary elliptical exercise machine 10. Extending upward from the longitudinal support beam 74 is a vertical or upright support 86 that functions to, among other things, assist in the support of first and second swing arms 102 and 122. The upright support 86 may comprise or support various known items or assemblies as commonly known in the art, such as a user interface, fixed handle bars, cup holders, magazine or book racks, etc. In the embodiment shown, first and second fixed handle bars 90 and 94 are supported atop the upright support 86.

The upright support 86 of the exemplary elliptical exercise machine 10 may comprise any shape or configuration. In one particular embodiment, the upright support 86 comprises a curved segment 88, which comprises an outward oriented curve that curves away from the drive assembly 112. The curved segment 88 may be configured to receive the drive assembly 112, or housing enclosing various components of the drive assembly 112 (shown as enclosure 114), in a nesting relationship when the rear portion 66 of the support base structure 70, and therefore the drive assembly 112, is pivoted upward to fold the elliptical exercise machine 10 into a more compact configuration as taught herein (see FIG. 2). By curving the upright support 86, and depending upon the location of the pivot joint or the pivot mechanism 170, the rear portion 66 may be rotated to a greater range of rotation before being interfered with by the upright support 86, thus achieving a more compact folded configuration than if the upright support 86 was not curved. As one skilled in the art will recognize, the location of the curved segment 88 along the upright support 86, as well as its degree or radius of curvature, will largely depend upon the location of the pivot mechanism 170 and the resulting vertical or upright resting position of the drive assembly 112, and/or enclosure 114, when in a folded configuration. In addition, the degree or radius of curvature of the curved segment 88 will depend upon the size and configuration of the drive assembly 112 or any enclosure enclosing the components of the drive assembly 112. Of course, the upright support 86 may comprise a curved, linear, spline, or other configuration, or any combination of these.

With reference to FIGS. 1-3, each of the second ends 22 and 52 of the first and second reciprocating foot supports 14 and 44 may be supported in any way commonly known in the art to enable the operation of the exercise machine 10, and particularly the reciprocating motion of the reciprocating foot supports 14 and 44. For example, the second ends 22 and 52 of the respective first and second reciprocating foot supports 14 and 44 may be supported via rollers that glide or roll along a track as is commonly known (and disclosed below with reference to FIGS. 11-14). However, in the exemplary embodiment shown in FIGS. 1-3, the second ends 22 and 52 of the first and second reciprocating foot supports 14 and 44 are pivotally coupled to first and second swing arms 102 and 122, respectively. The first and second swing arms 102 and 122 comprise elongate links having upper and lower ends and are configured to be laterally spaced apart on opposing left and right sides of the upright support 86. The first swing arm 102 is pivotally coupled to anchor 104, which is a component or an extension of the upright support 86, using any known coupling means. The anchor 104 is configured to support the first swing arm 102 and to allow the first swing arm 102 to pivot about axis 106. In a similar manner, the second swing arm 122 is pivotally coupled to anchor 124, which is also secured to the upright support 86. The anchor 124 is configured to support the second swing arm 122, and to allow the second swing arm 122 to pivot about axis 126. In this way, the first and second swing arms 102 and 122 are essentially pivotally coupled to the upright support 86. Of course, this specific type of coupling configuration is not meant to be limiting in any way as other coupling configurations may be possible and apparent to those skilled in the art, each of which are contemplated herein.

The lower ends of the first and second swing arms 102 and 122 are pivotally coupled to the second ends 22 and 52 of the first and second reciprocating foot supports 14 and 44, respectively, using any known coupling means. The first and second reciprocating foot supports 14 and 44 and the first and second swing arms 102 and 122 are configured to pivot about pivot points 110 and 130, respectively, during operation of the exercise machine 10. The swing arms 102 and 122 function to guide the first and second reciprocating foot supports 14 and 44, respectively, in a pendulous reciprocating motion along an arcuate closed path upon operation of the exercise machine 10. Travel about this arcuate closed path provides a substantially horizontal forward-rearward component of motion that effectively simulates a user's stride. Due to the coupling configuration of the reciprocating foot supports 14 and 44 at each of their respective second ends, the closed path traveled by the foot pads 30 and 60 is generally elliptical in nature.

In addition, the swing arms 102 and 122 are configured to permit the reciprocating foot supports 14 and 44 to pivot or fold upward on the swing arms 102 and 122, where they may be releasably coupled to the upright support 86, or one or more of its component parts. As shown in FIG. 1, the second swing arm 122 comprises an extension bracket 128 that functions to pivotally couple the reciprocating foot support 44 to the swing arm 122, as well as to allow the reciprocating foot support 44 to pivot upward so that it may releasably couple to anchor 124 supported by the upright support 86. Although not shown, the first swing arm 102 comprises a similar bracket and operates in the same manner as just described.

The elliptical exercise machine 10 further comprises first and second drive components, shown as first and second cranks or crank arms 140 and 160 rotatably supported about the base support structure 70 using any known means for supporting. It is contemplated that the present invention may be incorporated into an elliptical exercise machine comprising various types of drive components that are capable of rotating about a pivot point in either a concentric or eccentric manner. However, for the purposes of discussion, the exemplary drive components will be described as cranks 140 and 160. The cranks 140 and 160 are preferably in a fixed relationship with respect to one another and are configured to travel along repeating circular paths about a common pivot axis. The first and second cranks 140 and 160 are also configured to be out of phase with one another by 180° in order to facilitate an alternating reciprocating motion within the first and second reciprocating foot supports 14 and 44 and to simulate the natural alternating strides of a user. As shown, each of the cranks comprise a fixed or non-adjustable size or length.

To enable the base support structure 70 to breakaway and a portion of it to pivot or rotate upward in order to fold the elliptical exercise machine into a more compact configuration, the present invention further features first and second reciprocating foot supports 14 and 44 configured to detach from the respective drive components (see FIGS. 2 and 3). As such, and with general reference to FIGS. 1, 2 and 3, the elliptical exercise machine 10 further comprises means for releasably or detachably coupling the first ends of the reciprocating foot supports to the drive components 140 and 160, respectively. The means for releasably or detachably coupling is intended to allow each of the reciprocating foot supports 14 and 44 to detach from its respective drive component to enable the base support structure 70 to breakaway and fold into a compact configuration, as shown in FIG. 2. As is commonly known, to achieve a simulated striding motion, each of the reciprocating foot supports 14 and 44 are designed to be coupled to the respective drive components 140 and 160 at a position that is radially offset from the pivot axis of the drive components, thus allowing each of the reciprocating foot supports 14 and 44 to traverse or travel about a closed path, wherein the closed path comprises a stride length. The stride length, as is commonly known in the art, is dictated, at least in part, by the relative distance between the attachment point of the reciprocating foot supports and the pivot points of the cranks. The first ends 18 and 48 of the first and second reciprocating foot supports 14 and 44 are rotatably supported about a distal or free end of the corresponding cranks 140 and 160. As so supported, the reciprocating foot supports 14 and 44 are allowed to move rearward and forward and up and down along a closed path during operation of the exercise machine 10.

Figure 5:
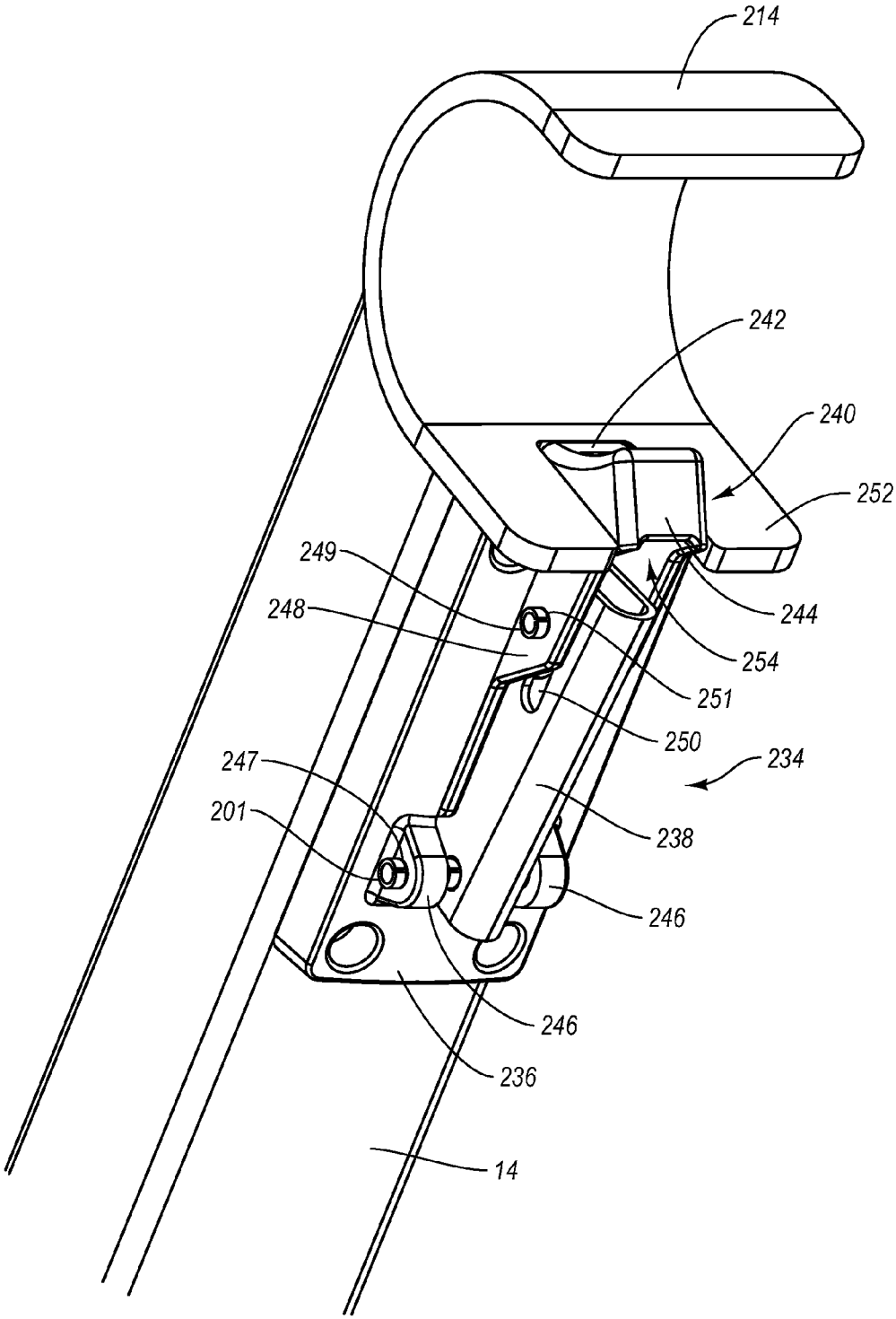
FIG. 5-A illustrates an enlarged, cut-away perspective rear view of one embodiment of a locking mechanism of a reciprocating foot support of FIG. 4.

Means for releasably coupling the reciprocating foot supports to the respective drive components may comprise a number of different coupling configurations, some of which are illustrated in the drawings and described herein. Specifically, as shown in FIGS. 3, 4 and 5, one exemplary means for coupling comprises a coupling configuration 190, wherein first and second struts 194 and 206 are coupled to and extend orthogonally outward from the cranks 140 and 160, respectively. The struts 194 and 206 are shown as being coupled directly to the cranks 140 and 160. Each of the first and second struts 194 and 206 further comprise rotating collars 198 and 210, respectively, configured to rotatably receive and couple the first ends 18 and 48 of the first and second reciprocating foot supports 14 and 44, respectively. The rotating collars 198 and 210 are configured to allow the first and second reciprocating foot supports 14 and 44 to rotate about a path of rotation when coupled to the struts 194 and 206, wherein each path of rotation is radially offset a distance from the pivot points of the cranks 140 and 160. Thus, as the exercise machine 10 is operated and the first and second cranks 140 and 160 are rotated along their respective circular paths, the offset position of the paths of rotation of the reciprocating foot supports 14 and 44, as provided by the struts 194 and 206, with respect to the pivot points of the cranks 140 and 160, as well as the suitably supported second ends 22 and 52 of the reciprocating foot supports 14 and 44, causes the reciprocating foot supports 14 and 44 to traverse an elliptical closed path.

As indicated, each of the first and second reciprocating foot supports 14 and 44 are removably coupled to first and second struts 194 and 206, respectively. In the embodiment shown, first ends 18 and 48 of the reciprocating foot supports 14 and 44, respectively, each comprise a clasp, shown as clasps 214 and 218, configured to releasably engage and couple to the rotating collars 198 and 210 of the first and second struts 194 and 206, respectively. The clasps 214 and 218 each comprise a half-circle configuration with a radius that is slightly larger than that of the rotating collars, thus allowing the clasps 214 and 218 to engage with and to mate with the rotating collars. The openings of the half-circle clasps are positioned in a downward facing orientation, in order to allow the reciprocating foot supports 14 and 44 to be rotated downward to releasably engage the struts, as well as to support any downward or other forces acting thereon, such as those typically applied as a result of a user operating the elliptical exercise machine 10. To attach a reciprocating foot support to a strut of the drive component, the clasp of the reciprocating foot support is aligned with the strut and caused to engage and rest upon the rotating collar of the strut. In this position, the clasp allows the reciprocating foot support and the elliptical exercise machine to function as intended with the clasp and the rotating collar rotating about the shaft of the strut. When it is desired to fold the elliptical exercise machine, the reciprocating foot support is released from the strut simply by lifting up on the reciprocating foot support to disengage the clasp. Once disengaged or released, the reciprocating foot support may be rotated upward and caused to rest against the upright support 86 or a component thereof. This procedure may be performed for each of the reciprocating foot supports 14 and 44, as is shown in FIGS. 2-5. In the embodiment shown, anchors 104 and 124 each comprise a magnet attached thereto, shown as magnets 230 and 232, configured to releasably mate with each of the respective reciprocating foot supports 14 and 44 to facilitate folding of the elliptical exercise machine 10, as described herein. Of course, other means for coupling the reciprocating foot supports in an upright position may be used and are contemplated herein, as will be apparent to one skilled in the art. For example, the reciprocating foot supports may be coupled to the upright support, or one of its components, using straps, clips, etc. In another embodiment, the elliptical exercise machine may comprise a ratcheting system configured to operate with the reciprocating foot supports as pivotally coupled to the first and second swing arms.

As shown in FIGS. 5-A and 5-B, the reciprocating foot supports may further comprise a locking mechanism configured to temporarily lock the reciprocating foot supports to the drive components, and particularly to the struts of the drive components. For example, as shown in FIG. 5-A, and in one exemplary embodiment, the clasps 214 and 218 may comprise a complementary hinged member 222 thereto that is also in the form of a half-circle and that has a radius slightly larger than that of the struts. The hinged member 222 may be oriented in a position opposite the clasps so as to be able to engage an opposite side of the struts when the reciprocating foot supports are attached. Furthermore, the hinged member 222 may comprise a latch or lock of some sort, shown as latch 224, configured to latch or lock to the clasps when the reciprocating foot supports are positioned downward so that the elliptical exercise machine may be used, and that may also be unlocked or unlatched when it is desired to fold the elliptical exercise machine. The latch 224 is configured to releasably engage a corresponding aperture (not shown) to secure the member 222 in place.

In another exemplary embodiment, as shown in FIG. 5-B, the locking mechanism for the reciprocating foot supports may comprise a latch assembly 234. The latch assembly 234 may comprise a latch base 236 mounted to the underside of the first end 18 of the reciprocating foot support 14 using any know mounting means, such as screws or bolts. The latch base 236 is configured to support a trigger 238, as well as a biased latch 240 designed and configured to releasably engage the rotating collar or other portion of the strut of the drive assembly (see rotating collar 198, strut 194, and drive assembly 112 in FIG. 1) in order to lock the reciprocating foot support 14 to the strut and the drive assembly when the reciprocating foot support 14 and the elliptical exercise machine are in a normal operating and functioning position. The latch 240 comprises a curved surface 242 having a radius that corresponds to the radius of the rotating collar or other portion of the strut. The latch 240 further comprises a pressure surface 244 formed on an incline with respect to a longitudinal axis of the reciprocating foot support 14, wherein the pressure surface 244 is designed and configured to facilitate the displacement of the latch 240 in response to a load large enough to overcome the pre-set load placed on the latch 240 by a biasing member, such as a spring (not shown), in the event the trigger 238 is actuated. In the embodiment of FIG. 5-B, there are two coil springs to bias the latch 240 to its "closed" position.

The trigger 238 is supported on one end via anchors 246 extending from the latch base 236, and on another end via a slider 248. The anchors 246 pivotally couple the trigger 238 to the latch base 236. More specifically, the anchors 246 are configured to receive an end of the trigger 238 therein and to facilitate its rotation upon the trigger 238 being actuated to release the reciprocating foot support 14 from the strut. The slider 248 is slidably coupled to the latch base 236 and is configured to allow the latch 240 to displace as the latch 240 is coupled to the slider 248. The trigger 238 further comprises a slot 250 formed therein, which is configured to also facilitate the release and displacement of the latch 240. In the exemplary embodiment shown, the slot 250 comprises an L-shape configuration with a horizontal and vertical portion. The slider 248 further comprises a pin 249 contained within the aperture 251. The pin 249 is configured to track along the slot in response to the bi-directional movement of the latch 240.

At the location of the anchors 246 on the latch base 234, there is an aperture 247 for receiving a roll pin 201 that acts as a hinge for the trigger 238 when the trigger is activated. In addition, in the embodiment of FIG. 5-B, there is a torsion spring (not shown) that biases the trigger 238 to return it to its "resting" position after it is activated.

The latch assembly 234 further comprises a plate 252 coupled or mounted to the clasp 214 at an end proximate the first end 18 of the reciprocating foot support 14. The plate 252 comprises a slot 254 formed therein to allow the latch 240 to pass therethrough as it displaces in both directions.

To actuate the locking mechanism, or rather to enable the latch 240 to release or retract from its locked position, the trigger 238 is actuated. This causes pin 249 contained within the aperture 251 in the slider 248 to transition from the vertical portion of the slot 250 to the horizontal portion of the slot 250, thereby allowing the pin 249 and the slider 248 to displace in response to the displacement of the latch 240 caused by the application of a load, namely the lifting of the reciprocating foot support 14 off of the strut. In essence, the trigger 238 functions to release the latch 240 and to allow it to displace under a load.

Other types of locking mechanisms may be employed and are contemplated herein, such as a strap, an elastic member, etc.

It is specifically noted herein that the first and second reciprocating foot supports may comprise any type of mechanism, assembly, etc., configured to releasably couple their respective first ends to the drive components of the elliptical exercise machine. As such, the exemplary embodiments discussed herein and shown in the drawings, such as the inclusion of clasps positioned at the first ends, are not meant to be limiting in any way. Indeed, one skilled in the art will recognize other ways of releasably coupling the reciprocating foot supports to the drive components to accomplish the folding of the elliptical exercise machine as intended herein. These alternative ways are contemplated, and are intended to fall within the scope of the invention as claimed.

Figure 6:
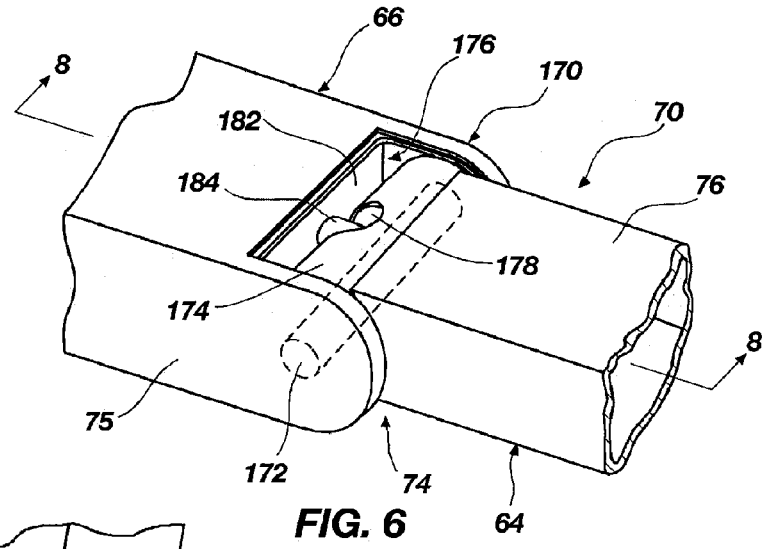
FIG. 6 illustrates another enlarged, cut-away view of the elliptical exercise machine of FIG. 1 in the operating position.
Figure 7:
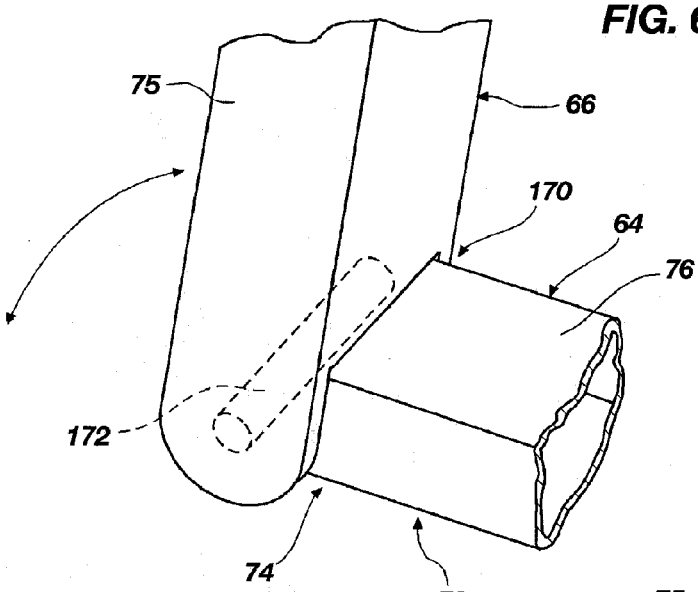
FIG. 7 illustrates another enlarged, cut-away view of the pivot mechanism of the exemplary elliptical exercise machine of FIG. 1 in the storage position.
Figure 8:
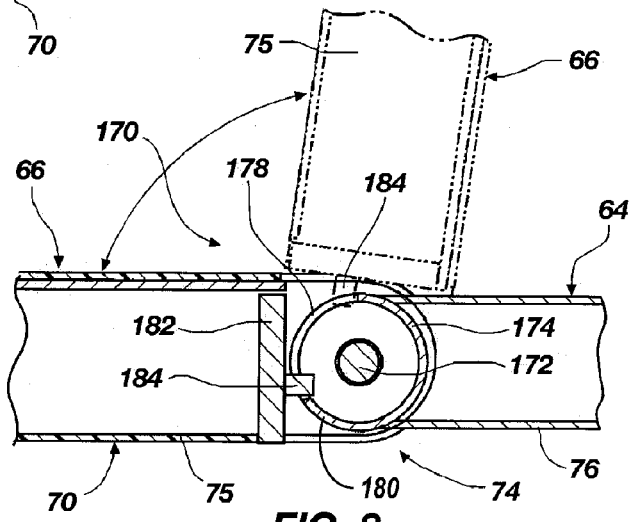
FIG. 8 illustrates a cross-sectional side view taken along lines 8-8 of FIG. 6.

FIGS. 6-8 show various detailed views of the base support structure 70 and the pivot mechanism 170 configured to enable the rear portion 66 to breakaway and fold upward and toward the front portion 64, according to one exemplary embodiment of the present invention. As shown, FIG. 6 illustrates the base support structure 70 in its lowered and unfolded state, and the rear portion 66 of the base support structure 70 supported and positioned on the ground such that the exercise machine is in the operating position. FIG. 7 illustrates the base support structure 70 in a folded, upright position such that the elliptical exercise machine is in its folded, compact configuration or storage position. FIG. 8 illustrates a detailed cross-sectional view of the base support structure 70 and the pivot mechanism 170, as taken along lines 8-8 of FIG. 6.

Specifically, with reference to FIGS. 6-8, the pivoting mechanism 170 provides a pivot joint within the longitudinal support beam 74 of the base support structure 70. The pivoting mechanism 170 comprises a pivot pin 172 operably retained within a suitable pin support member 174 formed or otherwise located on the end of the second piece 76 of the longitudinal support beam 74. The pivot pin 172 functions to pivotally couple the pin support member 174 and the second or front piece 76 to the first or rear piece 75 of the longitudinal support beam 74 within a complementary channel 176 formed in the first piece 75, thus pivotally coupling together the front and rear portions 64 and 66 of the base support structure 70. The channel 176 is configured to receive the front piece, or a portion thereof, for the purposes described.

The pivoting mechanism 170 further comprises a stop or limiting system. In the exemplary embodiment shown, the limiting system comprises a stop member 182 located within the channel 176 of the first piece 75 of the longitudinal support beam 74. The stop member 182 comprises a protrusion 184 that is configured to engage and slide within a corresponding slot 178 formed in a sidewall 180 of the pin support member 174. Being fixed to the first piece 75 of the longitudinal support beam 74, upon rotation of the rear portion 66 of the base support structure 70 to fold the elliptical exercise machine, the protrusion 184 travels within the slot 178. When the protrusion 184 contacts an upper edge of the slot 178, full rotation is reached. As such, the limiting system prohibits further rotation of the rear portion 66 of the base support structure 70. In essence, the limiting system, and particularly the protrusion 184 and the slot 178, functions to limit the rotation of the base support structure 70, and particularly the rear portion 66, in the upward direction. The protrusion 184 and the slot 178 may be configured to enable any suitable range of rotation of the rear portion 66 between 0° and 130°. As shown in FIG. 8, the rear portion 66 of the base support structure 70 may be rotated, and the elliptical exercise machine transitioned, from an approximately 0° position, wherein the rear portion 66 is situated on the ground or floor surface, to an approximately 110° breakaway position, wherein the rear portion 66 is in its fully rotated, upright, and folded state (shown in phantom). In this folded state, the drive assembly (see drive assembly 112 in FIG. 2) is supported off of the ground or floor surface, and the elliptical exercise machine is configured to comprise a compact configuration. In the exemplary embodiment shown in FIGS. 2 and 8, the protrusion 184 and slot 178 are configured to enable the rear portion 66 to be rotated past 90°, wherein the drive assembly 112 is able to nest with the curved segment 88 of the upright support 86, thus allowing the elliptical exercise machine to achieve a more compact configuration.

Figure 9:
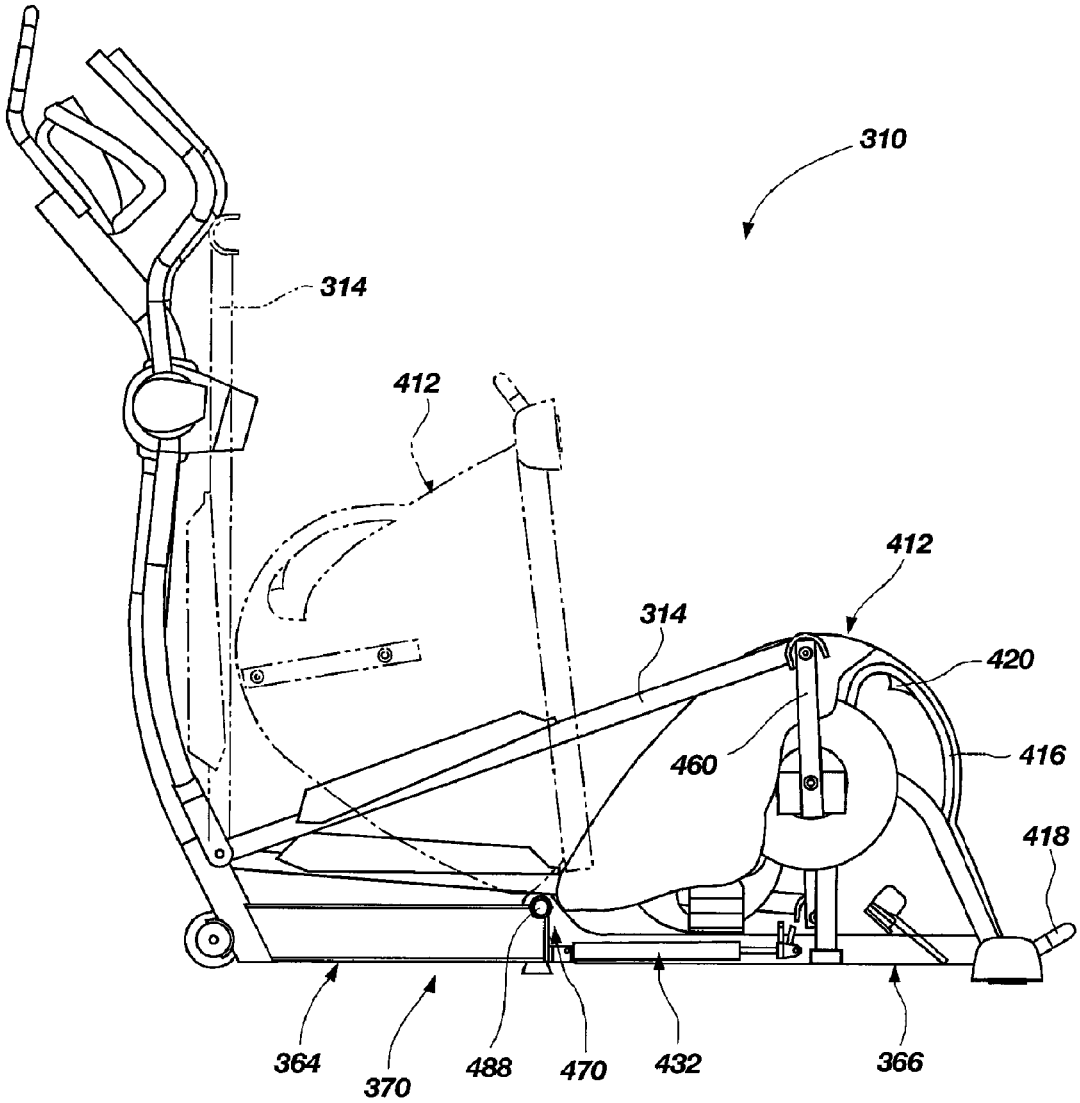
FIG. 9 illustrates another embodiment of a rear mechanism elliptical exercise machine of the present invention.
Figure 10:
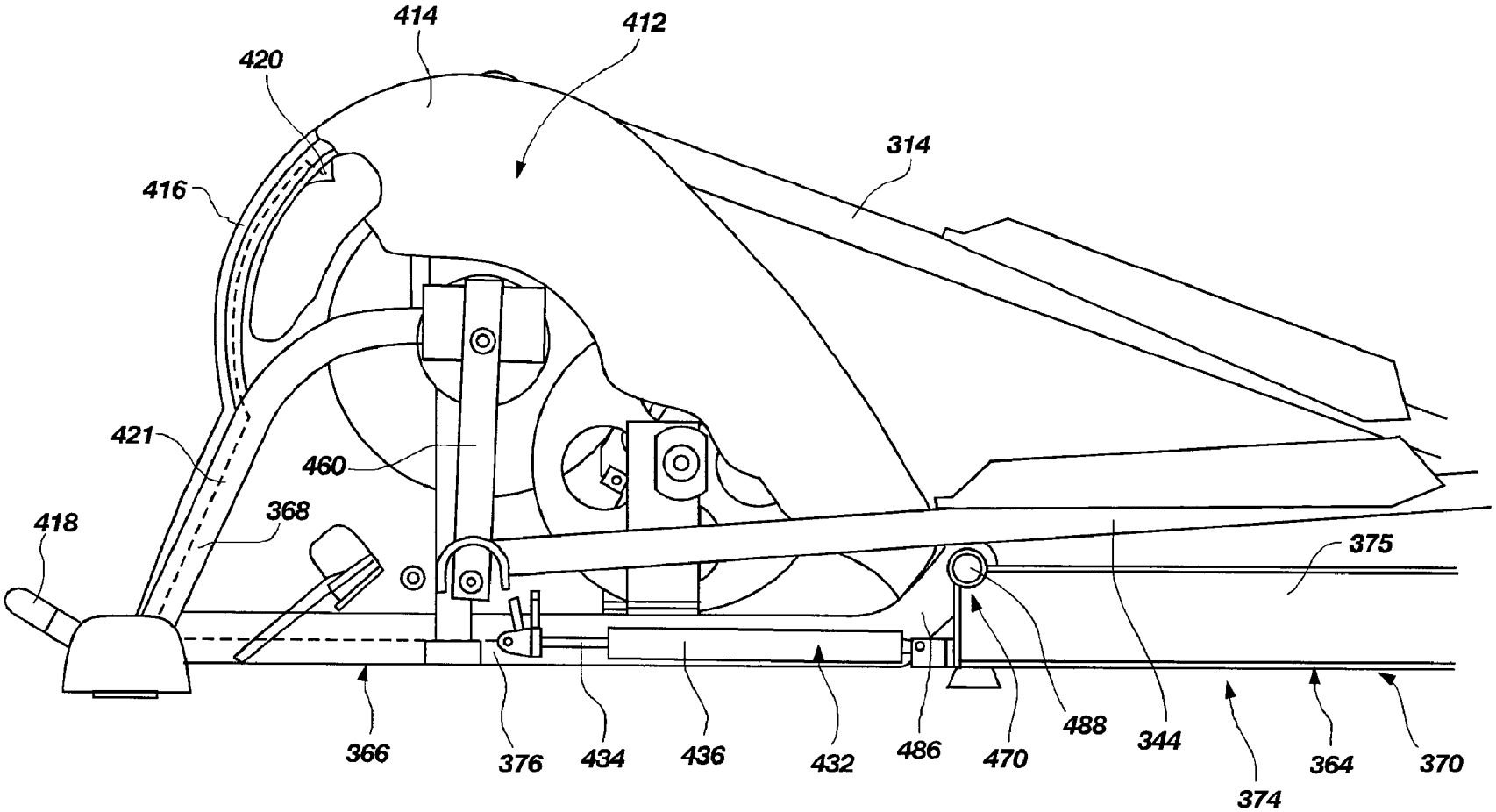
FIG. 10 illustrates a detailed side view of the exemplary elliptical exercise machine of FIG. 9.

FIGS. 9 and 10 show various side views of an elliptical exercise machine according to another exemplary embodiment of the present invention. As shown, the elliptical exercise machine 310 comprises a similar design as the one described above. As such, the above description above is incorporated herein, where applicable. However, in this embodiment, the elliptical exercise machine 310 comprises a differently configured base support structure 370. Specifically, the base support structure 370 comprises a front portion 364 hinged to a rear portion 366, thus allowing the rear portion 366, and the drive assembly 412 supported thereabout, to pivot upward into a folded position. The pivot mechanism 470 pivotally coupling the rear portion 366 of the base support structure 370 to the front portion 364, comprises a first hinged component in the form of a first piece 375 of the longitudinal support beam 374, a second hinged component 486 in the form of an upper extending portion 486 of a second piece 376 of the longitudinal support beam 374, and a pivot pin 488.

FIGS. 9 and 10 further illustrate an assist mechanism designed to assist the user in lifting the rear portion 366 and corresponding drive assembly 412 off of the ground and rotating them into a folded position. In the exemplary embodiment shown, the assist mechanism comprises a hydraulic actuator 432. The hydraulic actuator 432 comprises a hydraulic cylinder 436 and a piston 434 operably supported within the hydraulic cylinder 436. The hydraulic actuator 432 is coupled at one end to the front piece 375 of the longitudinal support beam 374, and at an opposite end to the second or rear piece 376 of the longitudinal support beam 374. In addition, the hydraulic actuator 432 is shown as being positioned offset from the pivot pin 488 of the pivot mechanism 470. This non-planar arrangement allows the hydraulic actuator 432 to assist in the folding of the elliptical exercise machine.

Upon release of the reciprocating foot supports 314 and 344 from their corresponding drive components (see drive component 460), and upon actuation, the hydraulic actuator 432 exerts opposing forces upon both the first and second pieces 375 and 376, or the front and rear portions 364 and 366, that causes the rear portion 366 to pivot about the pivot pin 488 and to rotate upwards towards a folded position. Stated differently, the hydraulic actuator 432 induces a moment within the rear portion 366 about the pivot pin or pivot point 488, which moment functions to assist the user in lifting the rear portion 366 and folding the elliptical exercise machine into a compact configuration.

The assist mechanism may further be configured to provide assistance in folding the elliptical exercise machine into its compact configuration, as well as unfolding the elliptical exercise machine from its compact configuration into its unfolded position for use. In other words, the present invention contemplates an assist mechanism that comprises a dual assist function, or a bi-directional assist function. It is also contemplated that the assist mechanism may be configured to comprise a single assist function, wherein the assist mechanism provides one-way directional assistance with either the folding or unfolding of the elliptical exercise machine.

The assist mechanism may comprise other types of actuators, such as a pneumatic actuator. In addition, the assist mechanism may comprise a ratchet system operable with the pivot mechanism.

FIG. 10 further illustrates a trigger 420 located within the handle 416 formed within the drive assembly 412. The trigger 420 is operably coupled to the hydraulic actuator 432 via connection means 421 routed through the various structural support components of the frame, such as member 368. The connection means 421 may comprise any type of mechanical or electrical connection known in the art. Essentially, the trigger 420 is designed to provide the user with means for actuating the hydraulic actuator 432 when desired. In addition, the trigger 420 functions to allow the user to position the rear portion 366 in any intermediate folding position. Indeed, release of the trigger 420 deactivates the hydraulic actuator 432, which deactivation may occur at any time within the available range of rotation of the rear portion 366. In FIG. 10, the hydraulic actuator 432 is comprised of a suitable size and strength to support the rear portion 366 and the supported drive assembly 412 in any intermediate position. The trigger 420 provides another useful function, namely to prevent inadvertent dropping or downward rotation of the base support structure 370 when folding or unfolding the elliptical exercise machine 310. This may be accomplished by deactivating the trigger at any time.

The hydraulic actuator 432 may be supported on the outside of the second piece 376 of the longitudinal support beam 374 or within the interior tubing of the second piece 376.

FIGS. 9 and 10 further illustrate a secondary handle 418 located about the rear portion 366, which is also designed to assist the user in lifting the rear portion 366 and folding the elliptical exercise machine 310 into a compact configuration. The specific location of the handles 418 and 416 as shown in the drawings are not intended to be limiting in any way.

Figure 11:
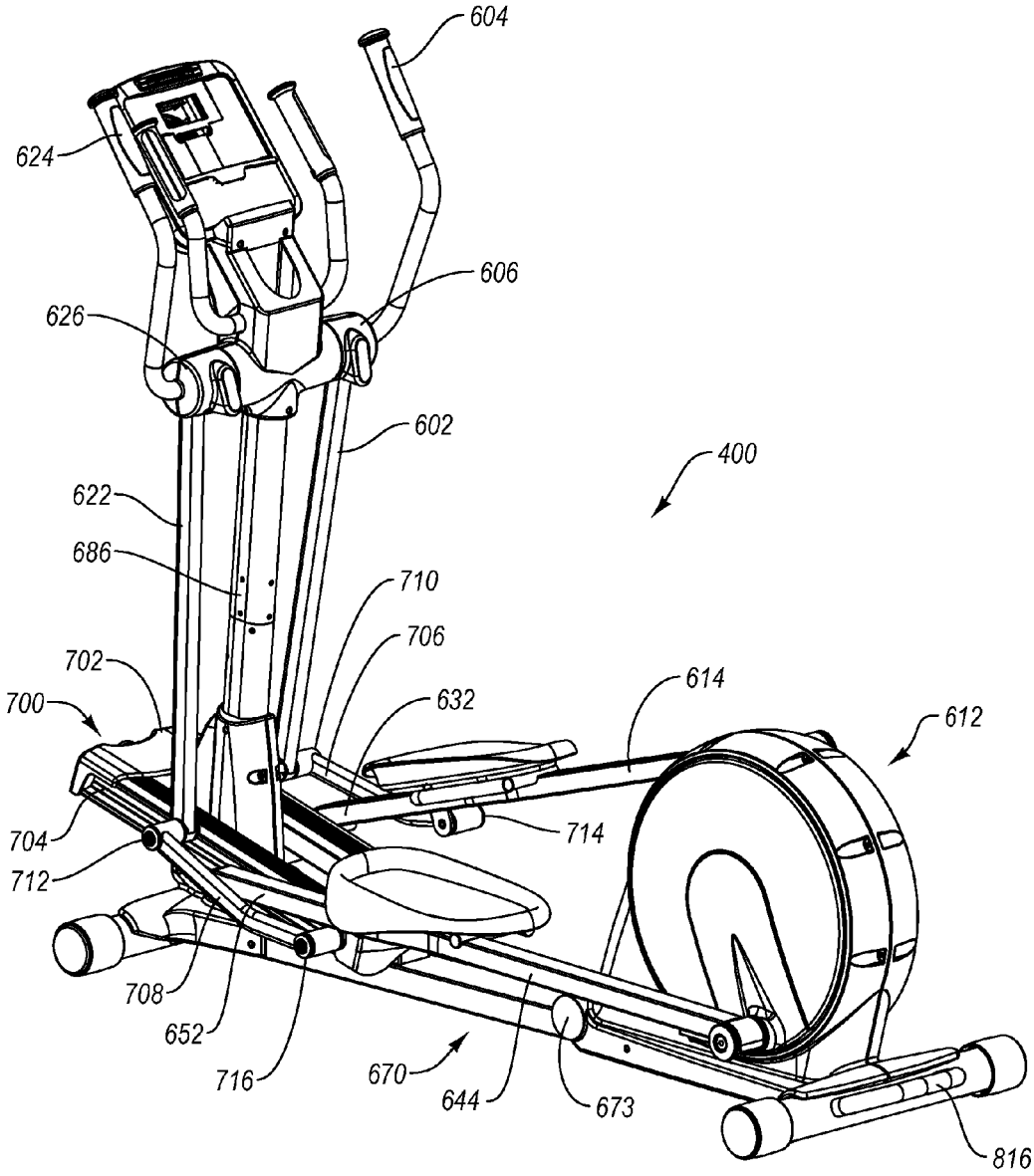
FIG. 11 illustrates a perspective view of another embodiment of rear mechanism elliptical exercise machine according to the present invention in its operating position.

FIGS. 11-14 depict another embodiment of a folding elliptical exercise machine of the present invention. FIG. 11 shows a perspective view of a rear mechanism elliptical exercise machine 400 in its operating position. The exercise machine 400 comprises a base support structure 670, a drive assembly 612, a first reciprocating foot support 614, a second reciprocating foot support 644, a first swing arm 602, a second swing arm 622, and an upright support structure 686. The base support structure 670 and the upright support structure 686 together comprise the frame of the exercise machine 400.

As compared to the aforementioned embodiments, the elliptical exercise machine 400 further comprises a ramp assembly 700 that interconnects the first and second swing arms 602 and 622 to the first and second foot supports 614 and 644, respectively, by means of first and second ramps 702 and 704 (or guide rails) of the ramp assembly 700, first and second link arms 706 and 708, the respective second ends 632 and 652 of each of the first and second foot supports 614 and 644, a respective first pivot point 710 and 712 where each swing arm 602 and 622 connects with each link arm 706 and 708, and a respective second pivot point 714 and 716 where each link arm 706 and 708 connects with each foot support 614 and 644.

In operation, when the user, for example, moves his or her foot such that the second foot support 644 moves forward, the second end 652 of foot support 644 slides forward along and inside guide rail 704. Second pivot point 716 is situated on the underside of foot support 644. As foot support 644 moves forward, so does pivot point 716, and because pivot point 716 is connected to link arm 708 it too moves forward, thereby also causing swing arm 622 to rotate such that the handle 624 of the swing arm 622 moves toward the user, as each swing arm pivots about anchors 606 and 626, respectively. The other side of the exercise machine, i.e., the side with respect to foot support 614 operates in identical fashion as that just described with respect to foot support 644 but out of phase by 180 degrees as dictated by drive assembly 612.

Figure 12:
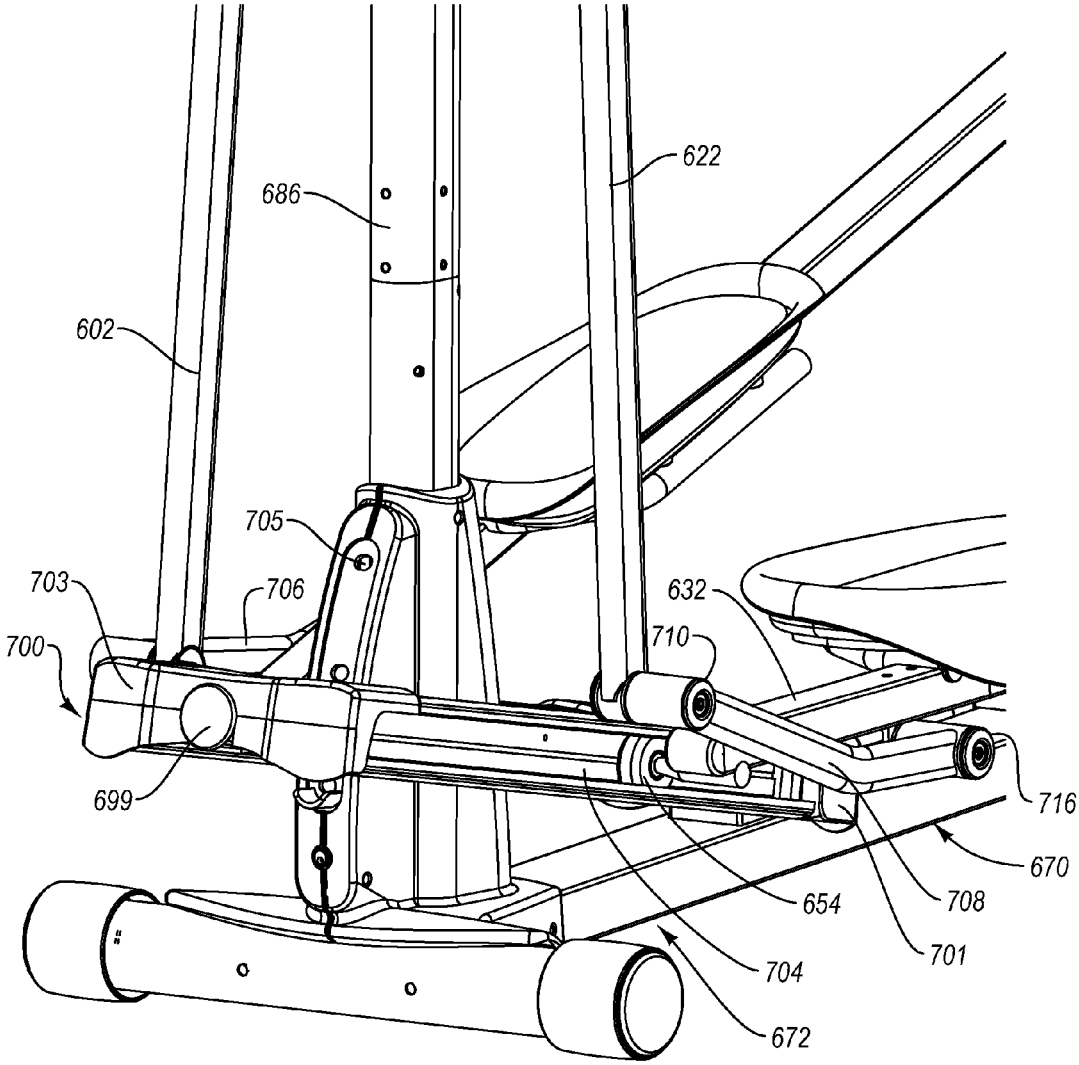
FIG. 12 illustrates an enlarged, cut-away view of the area around the second end of the foot support of the exercise machine of FIG. 11.

FIG. 12 shows an enlarged, cut-away view of the area around the second end 652 of the foot support 644 of the exercise machine 400 of FIG. 11. Specifically, FIG. 12 shows that the second end 652 further comprises a guide wheel 654 affixed to the second end 652 of foot support 644 for rolling forward and backward in guide rail 704 of the ramp assembly 700. As above, the other side of the exercise machine 400 and specifically, the second end 632 of foot support 614 operates in identical fashion as that just described with respect to foot support 644 but out of phase by 180 degrees.

Figure 13:
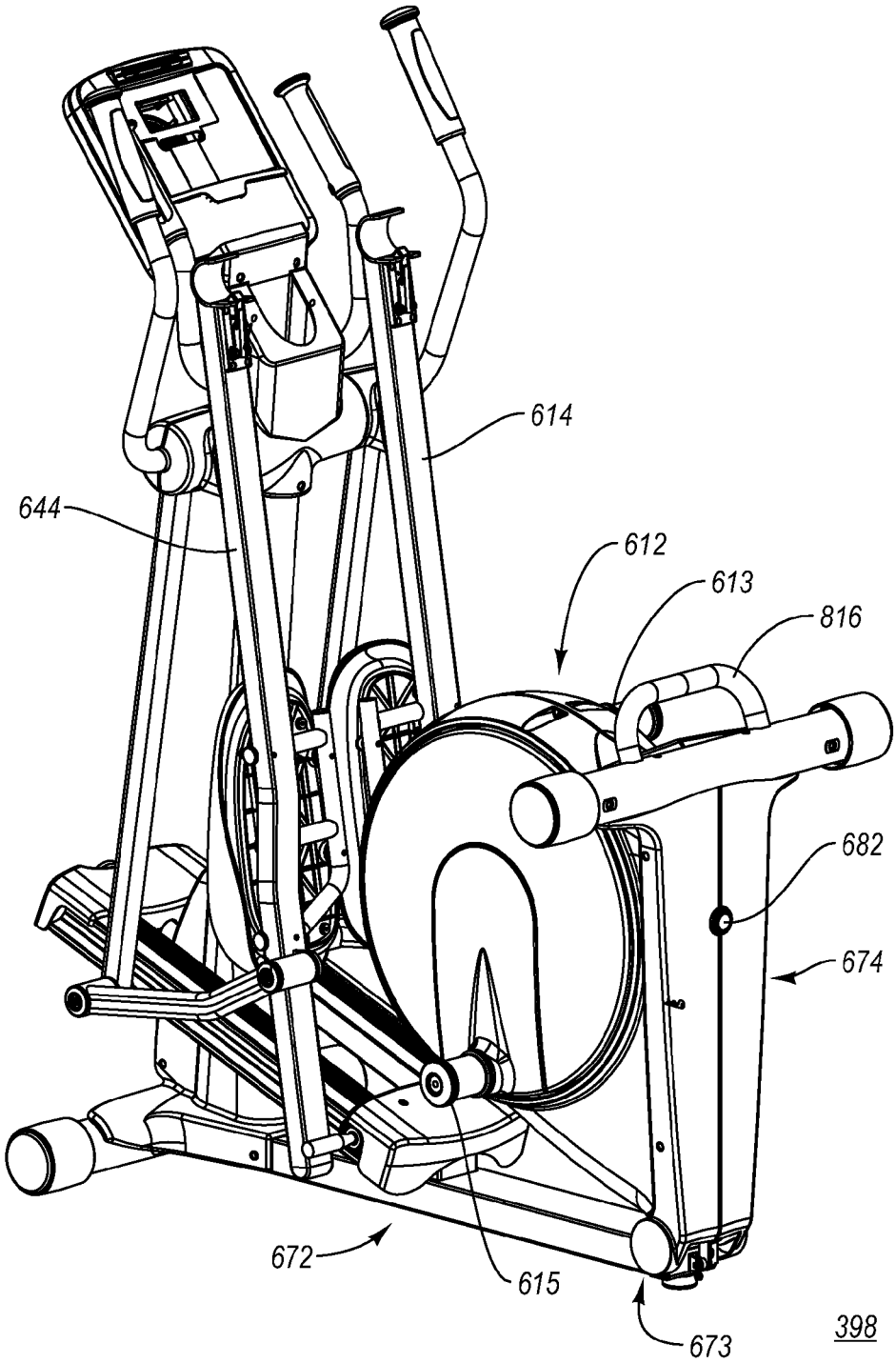
FIG. 13 illustrates a perspective view of the elliptical exercise machine of FIG. 11 in its folded, storage position.

As with the other embodiments set forth above, the exercise machine 400 folds in accordance with the principles of the present invention. FIG. 13 shows the exercise machine 400 in its folded, storage position. Except for the structural differences in which the swing arms 602 and 622 are interconnected to the foot supports 614 and 644, respectively, the exercise machine 400 folds in substantially the same fashion as does the exercise machine 10 of FIGS. 1-3. In the embodiment of exercise machine 400, a key benefit of link arms 706 and 708 is that the exercise machine 400 can readily fold into and out of the storage position in spite of the ramp assembly 700. The various parts of the interconnection between the swing arms 602 and 622 and the foot supports 614 and 644 facilitate this ability to fold and unfold of the exercise machine 400. Further, in the embodiment of exercise machine 400, the locking mechanism for each of the reciprocating foot supports 614 and 644 is that shown in FIG. 5B, although many locking mechanisms are possible within the principles of the invention.

Similar to the exercise machine 10, the base support structure 670 of the exercise machine 400 comprises a front portion 672 and a rear portion 674, separated by a pivot mechanism 673. Also similar to exercise machine 10, the drive assembly 612 of the exercise machine 400 is situated on top of the rear portion 674 of the base support structure 670. Similar to operation of exercise machine 10, to fold the exercise machine 400, the user first disengages the foot supports 614 and 644 from the struts 613 and 615, respectively, of the drive assembly 612 and temporarily affixes the foot supports 614 and 644 to the upright support structure 686, as shown in FIG. 13. The user then grabs the handle 816, lifts the rear portion 674 and rotates it upward and toward the upright support structure 686. FIG. 13 shows the exercise machine 400 after the aforementioned steps are performed. Note that these steps also are substantially as shown in FIGS. 2 and 3 and described in the accompanying text with respect to exercise machine 10.

As shown in FIGS. 11-13, the ramp assembly 700 of the exercise 400 is fixed to the front portion 672 of the base support structure 670 and when in operation, does not move with respect to the upright support structure 686 and the base support structure 670 of the exercise machine 400. As shown in FIG. 12, the ramp assembly 700 has a first end 701 fixed at the base support structure 670 that is lower than a second end 703, where it is adjustably mounted on the upright support structure 686 by any means known in the art. For example, the ramp assembly 700 can be locked in place with an interlocking pin 699 that is placed through the assembly 700 and into one of several holes 705 that are arranged vertically on the upright support structure 686 to arrive at a desired angle for the ramp assembly 700. Further, in such an embodiment, a spring mechanism would bias the pin 699 toward keeping the pin and thereby the assembly 700 in the locked position. As shown in FIG. 12, when the second end 703 of the ramp assembly 700 is raised, the angle that the ramp assembly 700 makes with the ground (or base support structure 670) is thereby increased, which thereby changes the elliptical path of each of the foot supports 614 and 644 of the elliptical exercise machine 400. Alternatively, in another embodiment, the method of changing the angle of the ramp assembly 700 is motorized.

Although not shown here, the pivoting mechanism 673 of exercise machine 400 further comprises a stop or limiting system, as shown in FIGS. 6-8 and described in the accompanying text, so that the rear portion 674 and drive assembly 612 do not rotate farther than intended, which is an angle of approximately 90 degrees between the rear portion 674 and the front portion 672 of the base support structure 670.

Figure 14:
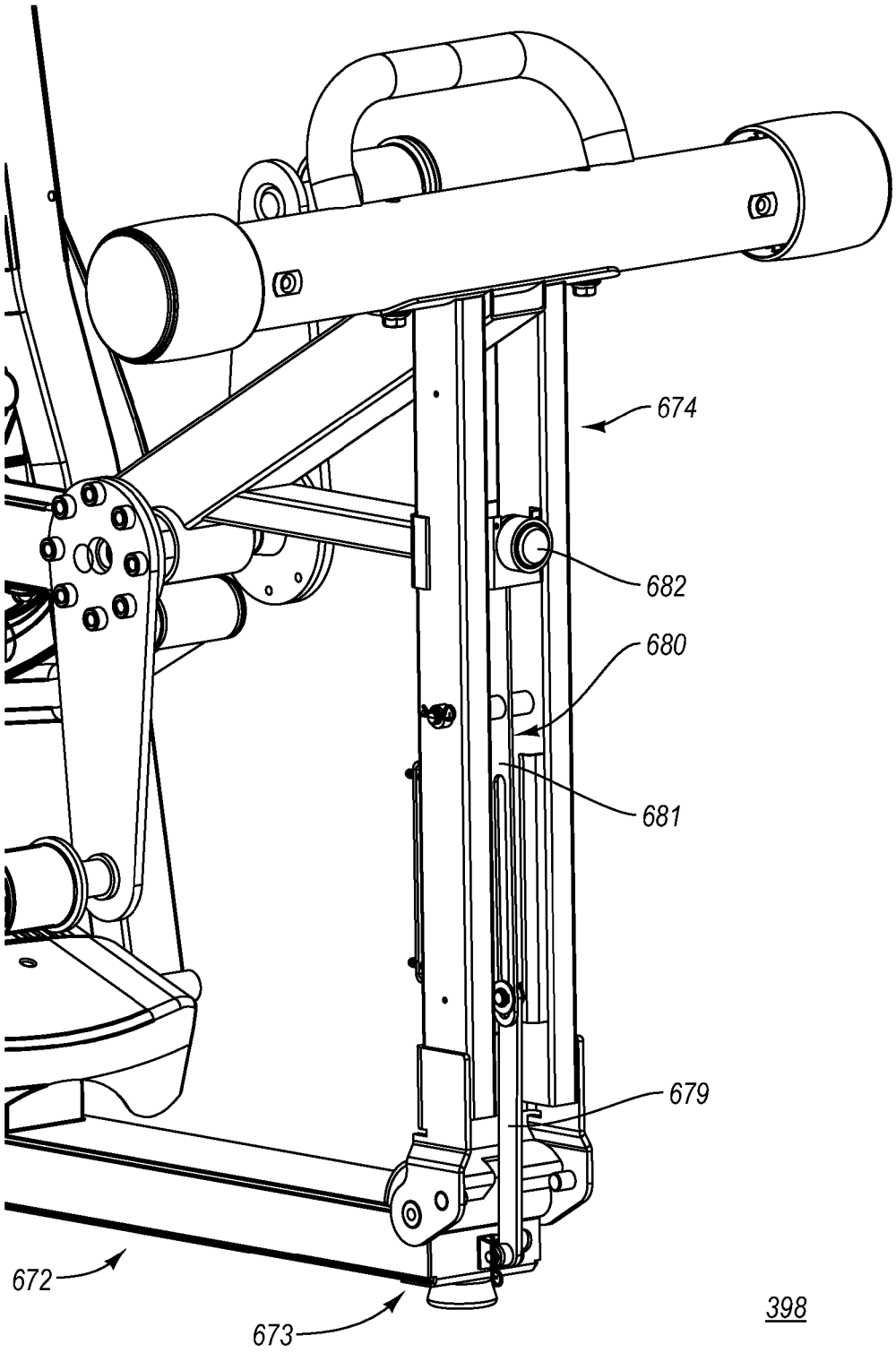
FIG. 14 illustrates shows an enlarged, cut-away view of the area of the rear of the elliptical exercise machine of FIG. 11 without a housing covering the rear portion and the drive assembly.

FIG. 14 shows an enlarged, cut-away view of the area around the pivot mechanism 673 of the base support structure 670 of the exercise machine 400. Specifically, FIG. 14 shows a view of the exercise machine 400 without a housing covering the rear portion 674 and the drive assembly 612, thereby illustrating the inner workings of the rear portion 674 of the base support structure 670. In addition to the stop as shown in FIGS. 6-8, the rear portion 674 comprises a locking mechanism 680 that prevents the rear portion 674 from inadvertently returning to the operating position, i.e., from inadvertently falling back down to the support surface 398. When the user wants to move the machine 400 from the storage position to the operating position, he or she presses the button 682 to disengage the locking mechanism 680 and grabs the handle 816 to rotate the rear portion 674 and the drive assembly 612 downward until the rear portion 674 is on the support surface 398 in its operating position. The user then replaces foot supports 614 and 644 in their respective positions on the struts 613 and 615 of the drive assembly 612.

The locking mechanism 680 may take many forms. The locking mechanism 680 shown in FIG. 14 comprises a lower elongate member 679 and an upper elongate member 681. The lower elongate member 679 is situated at its lower end proximate the pivot mechanism 673, the upper elongate member 681 is situated at its upper end proximate the button 682, and the two members 679 and 681 cooperate in between at their respective opposite ends. When initially placed in its storage position, the upper end of the lower member 679 and the lower end of the upper member 681 engage each other such that they are locked in place, preventing the rear portion 674 from inadvertent return to the operating position. Simultaneously, a spring (not shown) causes the button 682 to protrude slightly from the rear portion of the base support structure 670. Depressing the button 682 causes the upper member 681 to move just enough to disengage the lock between the two members 679 and 681 such that the rear portion 674 can then be returned to the operating position. In the exercise machine 400 of FIGS. 11-14, the elongate members 679 and 681 are both rigid and metallic.

Upon completion of an exercise session, or for one or more other purposes, the elliptical exercise machine 10 may be folded into a more compact configuration for easy storage or transport. This is accomplished by releasing or detaching each of the reciprocating foot supports from the drive components and rotating them upward out of the way and temporarily coupling them to the anchors on the upright support. Once the reciprocating foot supports are detached and out of the way, the base support structure is caused to breakaway and the rear portion folded upward and toward the front portion as discussed herein.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

We claim:

1. A folding elliptical exercise machine comprising:

a base support structure having a front portion and a rear portion, wherein the rear portion is rotatably attached to the front portion such that the elliptical exercise machine is selectively moveable between an operating position and a storage position, wherein each of the front and rear portions are adapted to be positioned on a support surface when the elliptical exercise machine is in the operating position;

first and second reciprocating foot supports, each foot support having a first end and a second end, the first end of each foot support being movably linked to the base support structure; and a ramp assembly situated at the front portion of the base support structure, the ramp assembly having first and second guide rails for guiding the respective second ends of the first and second foot supports such that the foot supports move in an elliptical path when the elliptical exercise machine is in the operating position wherein each foot support moves in an elliptical path and wherein the ramp assembly is adjustable, such that the elliptical path of each foot support can be varied.

2. The folding elliptical exercise machine of claim 1, wherein a drive assembly is situated on the rear portion of the base support structure, the first end of each foot support being coupled to the drive assembly such that the first end of each foot support is movably linked to the base support structure.

3. The folding elliptical exercise machine of claim 2, wherein in the operating position, the respective first ends of the first and second foot supports are releasably coupled to the drive assembly.

4. The folding elliptical exercise machine of claim 1 further comprising an upright support structure extending upward from the front portion of the base support structure.

5. The folding elliptical exercise machine of claim 4 further comprising:

first and second swing arms, each arm having an upper portion and a lower portion, the upper portion of each arm being pivotally connected to the upright support structure, the lower portion of each arm being interconnected to the respective first and second foot supports.

6. The folding elliptical exercise machine of claim 5, further comprising:

first and second link arms, each link arm having a first end and a second end, wherein the lower portion of each swing arm is pivotally connected to the first end of each respective link arm and the second end of each respective link arm is connected to the respective first and second foot supports.

7. The folding elliptical exercise machine of claim 6, wherein each swing arm is pivotally connected to the first end of each respective link arm at the lower end of the lower portion of each swing arm.

8. The folding elliptical exercise machine of claim 1 further comprising a locking mechanism that, in the storage position, prevents the rear portion of the base support structure from inadvertently rotating with respect to the front portion of the base support structure.

9. The folding elliptical exercise machine of claim 8 further comprising a button for disengaging the locking mechanism such that the rear portion can rotate with respect to the front portion of the base support structure to place the exercise machine in the operating position.

10. The folding elliptical exercise machine of claim 9, wherein the locking mechanism and the button are situated on the rear portion of the base support structure.

11. The folding elliptical exercise machine of claim 1, wherein the front portion and the rear portion are rotatably attached at a pivot mechanism.

12. The folding elliptical exercise machine of claim 1, wherein in the operating position, the rear portion is situated on a support surface, and wherein in the storage position, the rear portion and the front portion make an angle of approximately ninety degrees.

13. The folding elliptical exercise machine of claim 4, wherein the ramp assembly further comprises a first end and a second end, wherein the first end is affixed to the front portion of the base support structure and the second end is adjustably mounted on the upright support structure such that an angle that the ramp assembly makes with the base support structure can be changed.

14. A folding elliptical exercise machine comprising:

a base support structure having a front portion and a rear portion, wherein the rear portion is rotatably attached to the front portion such that the elliptical exercise machine is selectively moveable between an operating position and a storage position, the base support structure situated on a support surface such that, in the operating position the front portion and the rear portion are situated on the support surface;

an upright support structure extending from the front portion of the base support structure;

first and second reciprocating foot supports, each foot support having a first end and a second end;

a drive assembly situated on the rear portion of the base support structure, wherein in the operating position, the respective first ends of the first and second foot supports are releasably attached to the drive assembly;

a ramp assembly having a first end situated at the front portion of the base support structure, the ramp assembly having first and second guide rails for guiding the respective second ends of the first and second foot supports such that each of the foot supports move in an elliptical path, wherein a second end of the ramp assembly is adjustably linked to the upright support structure such that the elliptical path of each foot support can be varied; and a locking mechanism that, in the storage position, prevents the rear portion of the base support structure from inadvertently returning to the support surface.

15. The folding elliptical exercise machine of claim 14 further comprising:

first and second swing arms, each arm having an upper portion and a lower portion, the upper portion of each arm being pivotally connected to the upright support structure, the lower portion of each arm being interconnected to the respective first and second foot supports.

16. The folding elliptical exercise machine of claim 15, further comprising:

first and second link arms, each link arm having a first end and a second end, wherein the lower portion of each swing arm is pivotally connected to the first end of each respective link arm and the second end of each respective link arm is connected to the respective first and second foot supports.

17. The folding elliptical exercise machine of claim 16, wherein each swing arm is pivotally connected to the first end of each respective link arm at the lower end of the lower portion of each swing arm.

18. The folding elliptical exercise machine of claim 14, wherein the front portion and the rear portion are rotatably attached at a pivot mechanism.

19. The folding elliptical exercise machine of claim 14, wherein in the storage position, the rear portion and the front portion make an angle of approximately ninety degrees.

20. The folding elliptical exercise machine of claim 14, wherein the ramp assembly further comprises a first end and a second end, wherein the first end is affixed to the front portion of the base support structure and the second end is adjustably mounted on the upright support structure such that an angle that the ramp assembly makes with the support surface can be changed.

21. A folding elliptical exercise machine comprising:

a base support structure having a front portion and a rear portion, wherein the rear portion is rotatably attached to the front portion such that the elliptical exercise machine is selectively moveable between an operating position and a storage position, the base support structure situated on a support surface such that, in the operating position the front and rear portions are situated on the support surface;

first and second reciprocating foot supports, each foot support having a first end and a second end;

a drive assembly situated on the rear portion of the base support structure, wherein in the operating position, the respective first ends of the first and second foot supports are releasably attached to the drive assembly; and a ramp assembly situated at the front portion of the base support structure, the ramp assembly having first and second guide rails for guiding the respective second ends of the first and second foot supports such that each of the foot supports move in an elliptical path, wherein the ramp assembly is angularly adjustable such that the elliptical bath of each foot support can be varied.

22. The folding elliptical exercise machine of claim 21 further comprising an upright support structure extending upward from the front portion of the base support structure.

23. The folding elliptical exercise machine of claim 22 further comprising:

first and second swing arms, each arm having an upper portion and a lower portion, the upper portion of each arm being pivotally connected to the upright support structure, the lower portion of each arm being interconnected to the respective first and second foot supports.

24. The folding elliptical exercise machine of claim 23, further comprising:

first and second link arms, each link arm having a first end and a second end, wherein the lower portion of each swing arm is pivotally connected to the first end of each respective link arm and the second end of each respective link arm is connected to the respective first and second foot supports.

25. The folding elliptical exercise machine of claim 24, wherein each swing arm is pivotally connected to the first end of each respective link arm at the lower end of the lower portion of each swing arm.

26. The folding elliptical exercise machine of claim 24, wherein the front portion and the rear portion are rotatably attached at a pivot mechanism.

27. The folding elliptical exercise machine of claim 24, wherein in the storage position, the rear portion and the front portion make an angle of approximately ninety degrees.

28. The folding elliptical exercise machine of claim 24 further comprising a locking mechanism that, in the storage position, prevents the rear portion of the base support structure from inadvertently returning to the support surface.

29. The folding elliptical exercise machine of claim 28 further comprising a button for disengaging the locking mechanism such that the rear portion can return to the support surface.

30. The folding elliptical exercise machine of claim 29, wherein the locking mechanism and the button are situated on the rear portion of the base support structure.

31. The folding elliptical exercise machine of claim 24, wherein the respective second ends of each foot support has one wheel attached thereto for engaging the respective first and second guide rails of the wheel assembly.

32. The folding elliptical exercise machine of claim 22, wherein the ramp assembly further comprises a first end and a second end, wherein the first end is affixed to the front portion of the base support structure and the second end is adjustably mounted on the upright support structure such that an angle that the ramp assembly makes with the support surface can be changed.

* * * * *

UNITED STATES PATENT AND TRADEMARK OFFICE

CERTIFICATE OF CORRECTION

PATENT NO. : 7,775,940 B2
APPLICATION NO. : 11/549530
DATED : August 17, 2010
INVENTOR(S) : Dalebout et al.

It is certified that error appears in the above-identified patent and that said Letters Patent is hereby corrected as shown below:

Column 3
Line 66, change “of rear” to --of a rear--

Column 4
Line 6, remove [shows]
Line 19, after “art” insert --to--

Column 11
Line 50, change “know” to --known--

Column 12
Line 21, change “latch base 234” to --latch base 236--

Column 20
Line 45, change “bath” to --path--

Signed and Sealed this
Eighth Day of March, 2011

David J. Kappos

David J. Kappos
*Director of the United States Patent and Trademark Office*